US006101350A

United States Patent [19]

Suzuki et al.

[11] Patent Number: 6,101,350

[45] Date of Patent: Aug. 8, 2000

[54] PHOTOSENSITIVE MEMBER CARTRIDGE AND DEVELOPER CARTRIDGE FOR USE IN AN IMAGE-FORMING APPARATUS

[75] Inventors: Tsutomu Suzuki, Nagoya; Shougo Sato, Seto; Yasushi Okabe, Nagoya, all of Japan

[73] Assignee: Brother Kogyo Kabushiki Kaisha, Nagoya, Japan

[21] Appl. No.: 09/281,947

[22] Filed: Mar. 31, 1999

[30] Foreign Application Priority Data

Feb. 26, 1999 [JP] Japan ..... 11-050231

[51] Int. Cl.[7] ..... G03G 21/16; G03G 21/18

[52] U.S. Cl. ..... 399/113; 399/111; 399/119

[58] Field of Search ..... 399/119, 113, 399/110, 116, 103, 111

[56] References Cited

U.S. PATENT DOCUMENTS

| | | | |
|---|---|---|---|
| 4,432,632 | 2/1984 | Yokota | 399/113 |
| 4,794,420 | 12/1988 | Ohashi et al. . | |
| 5,028,966 | 7/1991 | Kozuka et al. | 399/113 |
| 5,089,849 | 2/1992 | Hiraoka | 399/119 |
| 5,142,322 | 8/1992 | Surti | 399/113 |
| 5,170,212 | 12/1992 | DeCecca | 399/103 |
| 5,204,713 | 4/1993 | Yamamura | 399/119 |
| 5,266,998 | 11/1993 | Lee | 399/113 |
| 5,537,187 | 7/1996 | Sekine | 399/113 |
| 5,740,491 | 4/1998 | Imai . | |
| 5,749,027 | 5/1998 | Ikemoto et al. | 399/113 |
| 5,805,959 | 9/1998 | Hazama et al. . | |
| 5,845,176 | 12/1998 | Yoshida et al. . | |
| 5,878,309 | 3/1999 | Nomura et al. | 399/111 |
| 5,890,036 | 3/1999 | Karakama et al. | 399/111 X |
| 6,041,203 | 3/2000 | Suzuki et al. | 399/111 |

FOREIGN PATENT DOCUMENTS

| | | |
|---|---|---|
| 0 757 302 A2 | 2/1997 | European Pat. Off. . |
| 5-216304 | 8/1993 | Japan . |
| 6-95234 | 8/1993 | Japan . |
| 8-54786 | 2/1996 | Japan . |
| 9-062099 | 3/1997 | Japan . |
| 9-244484 | 9/1997 | Japan . |
| 9-319285 | 12/1997 | Japan . |

*Primary Examiner*—Susan S.Y. Lee
*Attorney, Agent, or Firm*—Oliff & Berridge, PLC

[57] ABSTRACT

A photosensitive member cartridge, having a photosensitive drum, is provided with guide grooves formed in opposite side walls of the photosensitive member cartridge. The guide grooves extend in an accurate shape from an upwardly open accommodating portion to a vicinity of a shaft of the photosensitive drum. A shaft of a developing roller has protruded opposite end portions that protrude outward from opposite sides of a case of a developer cartridge. The protruded end portions of the developing roller shaft are provided with bearings. When the developer cartridge is inserted into the accommodating portion toward the photosensitive drum, the guide grooves support and guide the bearings on the end portions of the developing roller shaft, so that the developer cartridge becomes properly set in the accommodating portion. An inverted triangular-shaped action-receiving portion, protruding from the outer surface of one of the opposite sides of the developer cartridge, is restrained from above by a lower contact portion of a lock lever that is disposed in the accommodating portion.

36 Claims, 23 Drawing Sheets

PHOTOSENSITIVE MEMBER CARTRIDGE AND DEVELOPER CARTRIDGE FOR USE IN AN IMAGE-FORMING APPARATUS

BACKGROUND OF THE INVENTION

1. Field of the Invention

The invention relates to an electrostatographic image forming apparatus employed in a copier, a facsimile, a laser printer and the like, and to a photosensitive member cartridge and a developer cartridge for use in the image forming apparatus.

2. Description of the Related Art

In some conventional image forming apparatuses for recording character or image data by supplying a developer to an electrostatic latent image formed on a photosensitive member (photosensitive drum) and transferring the visible image formed by the developer onto a recording medium, a cartridge-type process unit as disclosed in, for example, Japanese Patent Application Laid-open Nos. HEI 8-54786 and HEI 9-319285, (which correspond to U.S. Pat. Nos. 5,845,176 and 5,805,959, respectively) is employed in order to facilitate operations for maintenance, replacement, and the like.

According to the technology described in the aforementioned Japanese Patent Application Laid-open No. HEI 8-54786, after a photosensitive member cartridge incorporating at least a photosensitive member is set in a body (housing) of the image forming apparatus, a developer cartridge incorporating a developer containing chamber and a developing roller can be attached to and detached from the photosensitive member cartridge. The developer cartridge has a pair of forward and rearward guide pins that protrude from each one of the right and left sides of the developer cartridge.

The body housing has a first guide groove and a second guide groove that are formed in each one of the right and left side inner faces of the housing. The first and second guide grooves are elongated in up-down directions so that the forward and rearward guide pins of the developer cartridge can fit into the corresponding grooves from above. The shapes of the two guide grooves on each side inner face of the housing are arranged so that the developing roller of the developer cartridge comes into and out of the contact with the photosensitive drum of the photosensitive member cartridge while maintaining a predetermined posture. Therefore, the technology prevents the developer cartridge from impacting and damaging the photosensitive drum during replacement of the developer cartridge.

The technology described in the aforementioned Japanese Patent Application Laid-open No. HEI 9-319285 is intended to constantly form good quality images without fog and achieve a compact design of the process unit. The process unit set in the housing of the image forming apparatus incorporates a photosensitive member cartridge and a developer cartridge that are rotatably journaled by pins at positions which are across a straight line from the photosensitive drum, the straight line extending through the axis of the developing roller and substantially parallel to a tangent extending through a contact portion between the photosensitive drum and the developing roller, and which are above a straight line extending through the axis of the developing roller and the axis of the photosensitive drum.

In the latter technology, however, the provision of the journal makes it impossible to remove the developer cartridge alone. Moreover, the developer cartridge and the photosensitive member cartridge are connected by a tension spring urging them toward each other so that during image forming operation, the surface of the developing roller will be pressed against the surface of the photosensitive member (photosensitive drum) in order to form a visible image on the photosensitive member (photosensitive drum) in a developing area by supplying a thin layer of developer formed on the surface of the developing roller to an electrostatic latent image on the photosensitive member (photosensitive drum). Such a coupling arrangement between the developer cartridge and the photosensitive member cartridge also makes it impossible to replace the developer cartridge alone, for example, even if the developer (toner) runs out. That is, in such an occasion, the entire process unit must be replaced, which may be considered wasteful.

The former technology requires a user to hold the developer cartridge in a predetermined posture when inserting the forward and rearward guide pins, protruding laterally from the right and left sides of the case of the developer cartridge, into the vertically elongated first and second guide grooves formed in the right and left side inner faces of the apparatus body housing, or pulling the guide pins out of the grooves. If the developer cartridge in not held in the correct posture during the inserting or removing operation, the guide pins impinge on wall surfaces of the first and/or second guide grooves, so that the developer cartridge cannot be smoothly or easily inserted into, or pulled out of, the body housing.

Moreover, the guide pins, protruding from the side surfaces of the case of the developer cartridge, are subject to a problem of low mechanical strength. Further, the technology requires that the handling of the developer cartridge be facilitated by simplifying the operation of setting the developer cartridge into the press contact with the photosensitive member cartridge, and the operation of removing the developer cartridge therefrom, as much as possible.

SUMMARY OF THE INVENTION

Accordingly, it is an object of the invention to provide an image forming apparatus, a photosensitive member cartridge and a developer cartridge that allow smooth and simple cartridge replacement and that make it possible to precisely press the developing roller against the photosensitive member.

According to one aspect of the invention, there is provided an image forming apparatus including a photosensitive member on which an electrostatic latent image is formed, a developer cartridge having a developing roller that supplies a developer to the photosensitive member, opposite end portions of a developing roller shaft of the developing roller extending so as to protrude outwardly from a case, and a guide device which guides the developer cartridge to a position such that the developing roller faces the photosensitive member, and which guides and supports the opposite end portions of the developing roller shaft so that the developer cartridge becomes oscillatable about the developing roller shaft at a position such that the developing roller faces the photosensitive member.

In this image forming apparatus, the opposite end portions of the developing roller shaft, protruding outward from the case of the developer cartridge, are supported and guided by the guide device, so that it becomes unnecessary to separately provide such protrusions on the developer cartridge. Therefore, the structure of the developer cartridge can be simplified. Furthermore, since the opposite end portions of the developing roller shaft are used for the guiding operation, the rigidity and strength of the protruded portions, that is, support portions, are increased, so that breakage of the protruded portions becomes unlikely. Further, since only the end portions of the developing roller shaft need to be supported by the guide device in order to move the developing roller into, or remove it from, the contact with the photosensitive member, the operation of attaching or detaching the developer cartridge with respect to the photosensitive member cartridge becomes easier and the operation can be more quickly performed.

The image forming apparatus may further include an urging device that presses the developing roller against the photosensitive member via the developer cartridge.

The developing roller can be pressed against the photosensitive member simply by pressing the entire developer cartridge, so that the freedom in selecting sites to provide the urging device increases; for instance, sites convenient or suitable for the operation can more easily be selected.

The image forming apparatus may further include a photosensitive member cartridge that includes the photosensitive member and that is detachably attachable to an apparatus body. In the apparatus, the guide device and the urging device are disposed on the photosensitive member cartridge, and the developer cartridge is detachably attachable with respect to the photosensitive member cartridge.

Since the urging device and the guide device are provided on the photosensitive member cartridge, which requires less frequent replacement, the running cost can be considerably reduced in comparison with a structure in which the urging device and the guide device are disposed on a so-called disposable developer cartridge, which requires frequent replacement.

The image forming apparatus may be constructed so that during execution of an image forming operation, a direction of a rotation moment about the developing roller shaft, caused by a friction force that the developing roller receives from the photosensitive member, becomes substantially the same as a direction of a rotation moment about the developing roller shaft caused by a load at a center of gravity of the developer cartridge. With this structure, the image forming apparatus further includes a receiving member that receives the rotation moment caused by the friction force and the rotation moment caused by the load at the center of gravity of the developer cartridge.

Therefore, during image forming operation, although the aforementioned friction force acts as a torque about the rotational center (the developing roller shaft) of the developer cartridge, that rotation moment does not reduce or offset the rotation moment caused by the weight of the developer cartridge. Hence, even if the friction force fluctuates due to various factors, the developer cartridge will not rise relative to the photosensitive member cartridge, and instead remains stable. Another advantage that the developer cartridge can be stably supported merely by the receiving member receiving the total of the rotation moments is also achieved.

The image forming apparatus may also be constructed so that, while an image forming operation is being executed by a developing device, a direction of a rotation moment about the developing roller shaft caused by a friction force that the developing roller receives from the photosensitive member, a direction of a rotation moment about the developing roller shaft caused by load at a center of gravity of the developer cartridge, and a direction of a rotation moment about the developing roller shaft caused by a force transmitted to the developing roller shaft via an external power transmitting device, become substantially the same. With this structure, the image forming apparatus further includes a receiving member that receives the rotation moment caused by the friction force, the rotation moment caused by the load at the center of gravity of the developer cartridge, and the rotation moment caused by the force transmitted via the external power transmitting device.

Therefore, even if the drive torque acting on the developing roller shaft fluctuates, the developer cartridge is not raised relative to the photosensitive member cartridge, and instead the behavior of the developer cartridge stabilizes. Hence, the above-described structure achieves an advantage that the developing operation becomes further stabilized, as well as the advantages stated above.

In the image forming apparatus described above, the guide device may have a guide groove, and the end portions of the developing roller shaft may be provided with shaft bearings that are rotatable and slidable relative to the guide groove.

Therefore, when the developer cartridge is attached to, or detached from, the photosensitive member, the shaft bearings will be smoothly moved along the guide grooves without being stopped in the grooves.

According to another aspect of the invention, there is provided a photosensitive member cartridge including a photosensitive member on which an electrostatic latent image is formed, wherein a developer cartridge having a developing roller that supplies a developer to the photosensitive member can be attached to and detached from the photosensitive member cartridge. The photosensitive member cartridge further includes a guide groove that supports opposite end portions of a developing roller shaft of the developing roller and guides the developing roller in such directions that the developing roller contacts and separates from the photosensitive member. The photosensitive member cartridge is constructed so that the photosensitive member cartridge can be attached to and detached from an image forming apparatus, together with the developer cartridge attached to the photosensitive member cartridge.

Therefore, a developer cartridge can be attached to the above-described photosensitive member cartridge simply by moving the opposite end portions of the developing roller shaft along the guide grooves formed in the photosensitive member cartridge, so that the developing roller will be set at a predetermined position adjacent to the photosensitive member. The photosensitive member cartridge combined with the developer cartridge can be detachably set into an image forming apparatus. Consequently, the photosensitive member cartridge advantageously allows easy replacement of the photosensitive member cartridge or the developer cartridge while obviating the danger of exposing the photosensitive member or damaging component parts.

The photosensitive member cartridge may further include an urging device that presses the developing roller against the photosensitive member via the developer cartridge.

Therefore, the developing roller can easily be pressed through an operation performed on the side of the photosensitive member cartridge. Hence, the photosensitive member cartridge facilitates selection of a site of disposing the urging device that is convenient for operation.

In the photosensitive member cartridge, the guide groove and the urging device may be provided on each of opposite sides of the photosensitive member cartridge.

Since the aforementioned urging device and the guide grooves are provided in the photosensitive member cartridge, which requires less frequent replacement than the developer cartridge, the running cost can be reduced.

The photosensitive member cartridge may be constructed so that an image forming operation, a direction of a rotation moment about the developing roller shaft, caused by a friction force that the developing roller receives from the photosensitive member, becomes substantially the same as a direction of a rotation moment about the developing roller shaft caused by a load at a center of gravity of the developer cartridge. With this structure, the image forming apparatus further includes a receiving member that receives the rotation moment caused by the friction force and the rotation moment caused by the load at the center of gravity of the developer cartridge.

Therefore, during image forming operation, although the aforementioned friction force acts as a torque about the rotational center (the developing roller shaft) of the developer cartridge, that rotation moment does not reduce or offset the rotation moment caused by the weight of the developer cartridge. Hence, even if the friction force fluctuates, the developer cartridge is not raised relative to the photosensitive member cartridge, and instead the behavior thereof stabilizes. Another advantage that the developer cartridge can be stably supported merely by the receiving member receiving the total of the rotation moments is also achieved.

According to still another aspect of the invention, there is provided a developer cartridge including a developing roller that supplies a developer to a photosensitive member on which an electrostatic latent image is formed, and a developing roller shaft having opposite end portions that protrude from outer surfaces of opposite sides of the developer cartridge. The developer cartridge is constructed so that the developer cartridge is attachable and detachable and rotatable relative to one of a photosensitive member cartridge and an image forming apparatus.

In the developer cartridge, the opposite end portions of the developing roller shaft protruding outwardly from the developer cartridge are supported and guided by the guide member, so that it becomes unnecessary to separately provide protrusions on the developer cartridge. Therefore, the structure of the developer cartridge can be simplified. Furthermore, since the opposite end portions of the developing roller shaft are used for the guiding operation, the rigidity and strength of the protruded portions, that is, support portions, are increased, so that breakage of the protruded portions becomes unlikely. Further, since only the end portions of the developing roller shaft need to be supported by the guide device in order to move the developing roller into, or remove it from, the contact with the photosensitive member, the operation of attaching or detaching the developer cartridge with respect to the photosensitive member cartridge becomes easier and the operation can be more quickly performed.

The developer cartridge may further include pressing force-receiving portions that receive an action performed by an urging device that presses the developing roller against the photosensitive member, the pressing force-receiving portions being protruded from outer surfaces of opposite sides of the developer cartridge.

Therefore, the pressing force-receiving portions can by formed together with the developer cartridge, so that the production cost of the developer cartridge can be reduced.

The developer cartridge may further include bearings fitted to the opposite end portions of the developing roller shaft in such a manner that the bearings are prevented from detaching from the developing roller shaft.

Since the shaft bearings are prevented from detaching from the shaft, the developer cartridge can be safely replaced while obviating the danger of accidentally dropping or losing a shaft bearing and causing a problem in functionality or the like.

In the developer cartridge, at least one of the bearings may be urged outwardly in a direction of an axis of the developing roller shaft.

Therefore, the bearings slidingly contact the guide grooves, and are thereby supported without allowing rattling to occur.

BRIEF DESCRIPTION OF THE DRAWINGS

A preferred embodiment of the invention will be described in detail with reference to the following figures wherein:

FIG. 11(*b*) is a sectional view taken on plane XIb—XIb in FIG. 11(*a*);

FIG. 12(*b*) is a right side view of the developer cartridge;

FIG. 20(*b*) illustrates a situation in which the process unit is further inserted;

DETAILED DESCRIPTION OF PREFERRED EMBODIMENT

Figure 1:
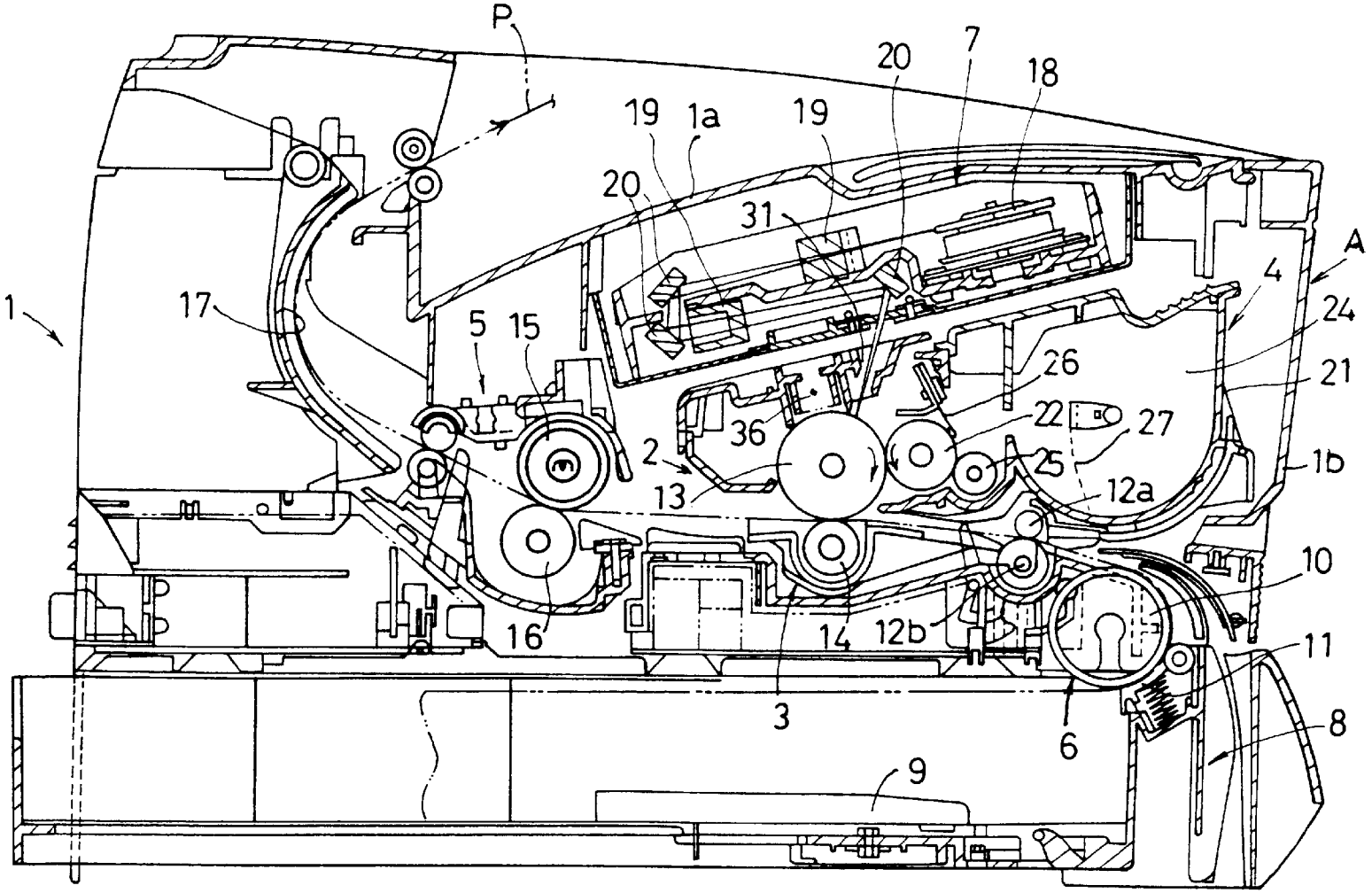
FIG. 1 is a schematic side sectional view of a printer embodying the image forming apparatus of the invention.
Figure 2:
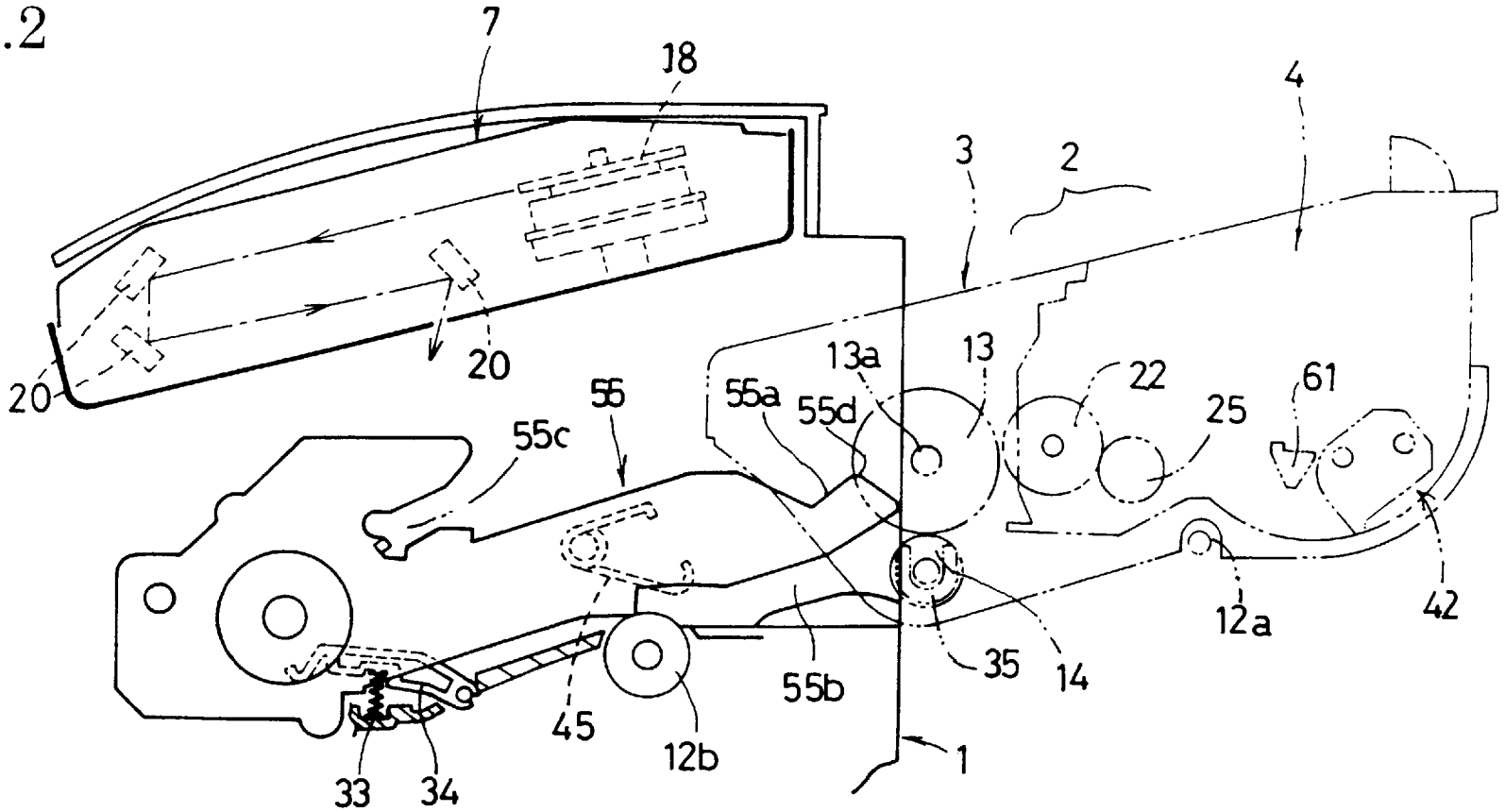
FIG. 2 is a side view of the printer, illustrating a situation where the insertion of a process unit into a body housing is started.

A preferred embodiment in which the invention is embodied in a laser beam-type printer will be described in detail hereinafter with reference to the accompanying drawings. FIG. 1 is a schematic side sectional view of a printer embodying the image forming apparatus of the invention. FIG. 2 is a partly cut-away side view of the printer, illustrating a situation where the insertion of a process unit 2 into a body housing 1 is started.

Referring to FIG. 1, the process unit 2 having a photosensitive member cartridge 3 and a developer cartridge 4 is removably disposed in a substantially central portion of the body housing 1 of the printer. As shown in a left portion of FIG. 1, a fixer 5 is disposed adjacent to the process unit 2. A sheet feeder 6 is disposed below the process unit 2. A sheet cassette 8 is attachable to a lower portion of the body housing 1 by moving the sheet cassette 8 from a front face of the body housing 1 (as indicated by arrow A).

A laser scanning unit 7 is mounted to a lower surface of a synthetic resin-made discharge sheet tray 1*a*, via a frame. The discharge sheet tray 1*a* also serves as a cover.

When print data is transmitted to the printer from an external apparatus, for example, a personal computer, upon a print instruction, a sheet P (recording medium) is separated from a stack of sheets P on a support plate 9 of the sheet cassette 8 by a separator pad 11, in a manner of one sheet at a time, as a sheet feed roller 10 of the sheet feeder 6 rotates. The separated sheet P is conveyed to a contact portion between a photosensitive drum 13 (photosensitive member) in the process unit 2 and a transfer roller 14 (transfer device) pressed against a lower face of the photosensitive drum 13, via a pair of register rollers 12*a*, 12*b*.

A laser beam is emitted from the laser scanning unit 7 having a laser light-emitting portion, a polygon mirror 18, a lens 19, a plurality of reflecting mirrors 20 and the like, through a light-emitting hole formed in a lower portion of the frame supporting the laser scanning unit 7. The laser beam travels to an upper peripheral surface portion of the photosensitive drum 13, via a light entrance portion 31 formed in a case 30 of the photosensitive member cartridge 3, that is, a case of the process unit 2. The peripheral surface of the photosensitive drum 13 is thereby exposed corresponding to the print data, so as to form an electrostatic latent image.

Developer (toner) supplied from a developing roller 22 of the developer cartridge 4 becomes deposited on the electrostatic latent image on the photosensitive drum 13, thereby making the image visible. After the visible image formed by developer (toner) is transferred from the photosensitive drum 13 to the sheet 2, the sheet P is conveyed between a heat roller 15 and a presser roller 16 in the fixer 5, in which the sheet P is subjected to a heat-fixing process. The sheet P is then discharged onto the discharge sheet tray 1*a* via a sheet discharge passage 17.

In this embodiment, the process unit 2 includes the photosensitive member cartridge 3 having at least the photosensitive drum 13, and the photosensitive member cartridge 3 having at least the developing roller 22 (developing device) that is disposed in a case 21. The developer cartridge 4 is designed so that the developer cartridge 4 is detachably attachable to the photosensitive member cartridge 3, and so that the developing roller 22 is prevented from detaching by a lock device 46 described later.

The structures of the photosensitive member cartridge 3 and the developer cartridge 4 will now be described in detail.

As shown in FIGS. 3 through 7, in the photosensitive member cartridge 3, the photosensitive drum 13 is rotatably journaled in the synthetic resin-made case 30, near one side thereof. A lower portion of the transfer roller 14 (transfer device) disposed below the photosensitive drum 13 is covered with a bottom wall 30*a* of the case 30 (see FIG. 4). The transfer roller 14 is vertically movably journaled in such a manner that the transfer roller 14 can separate from a lower surface of the photosensitive drum 13 due to the weight of the transfer roller 14.

Figure 8:
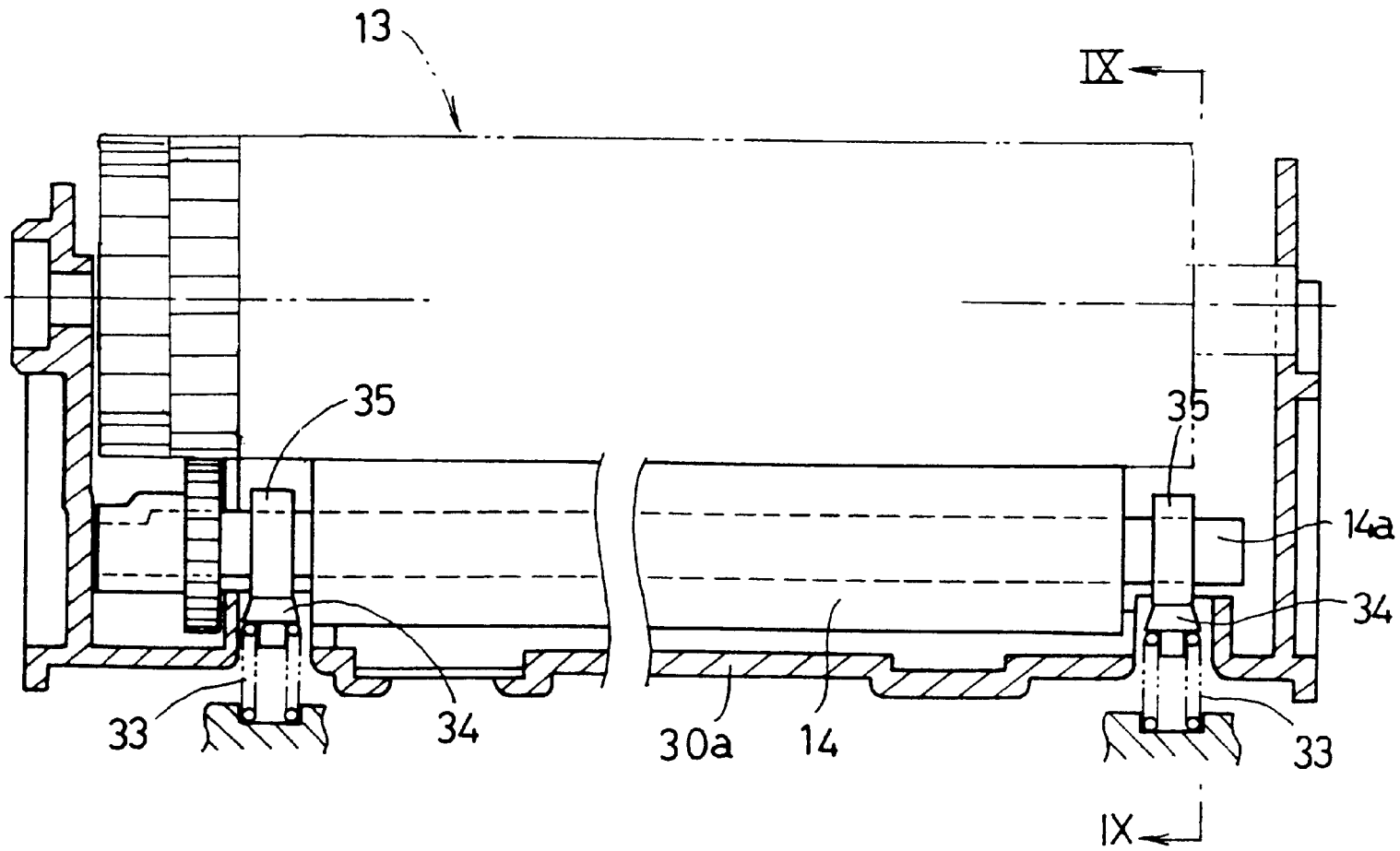
FIG. 8 is a partially cut-away sectional view illustrating a pressing portion of a transfer roller.
Figure 9:
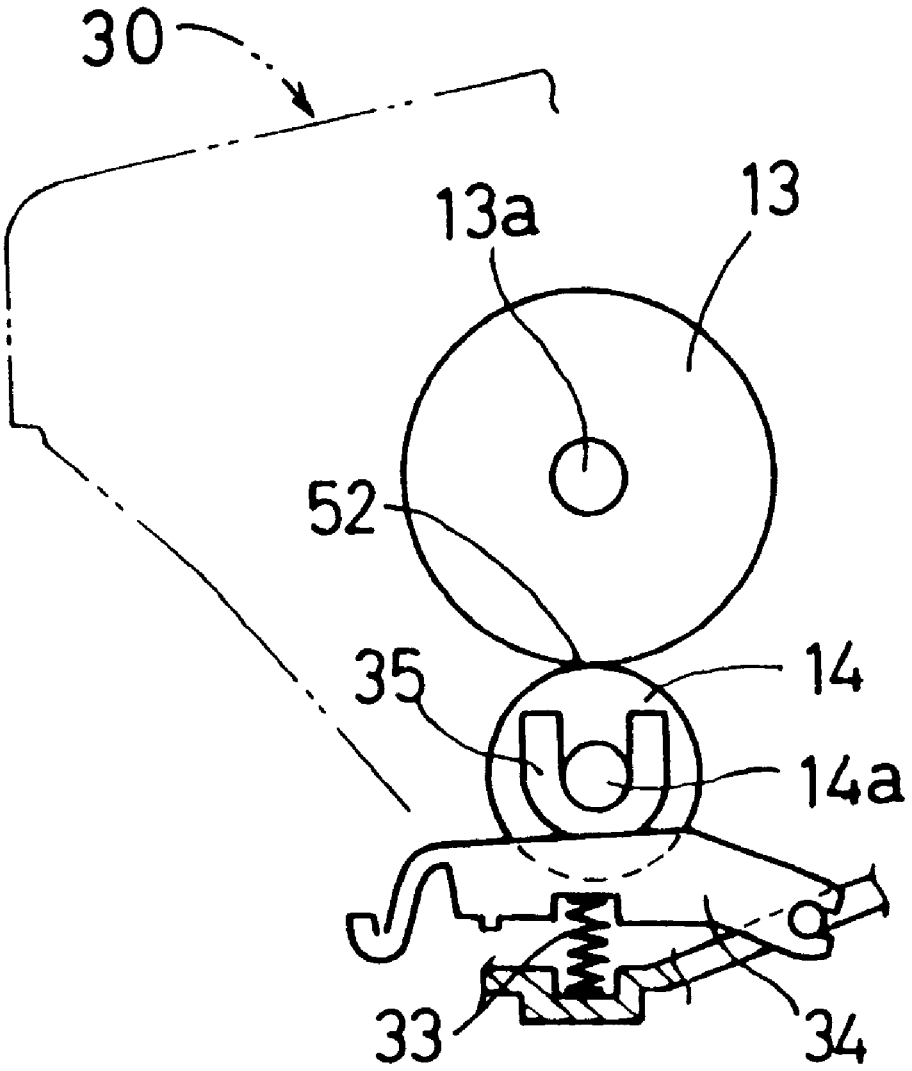
FIG. 9 is a sectional view taken on plane IX—IX in FIG. 8.

When the process unit 2 is set into the body housing 1, upwardly open "U"-shaped bearings 35 fitted to both end portions of a shaft 14*a* of the transfer roller 14 are raised by shaft bearing raiser 34 (see FIGS. 8 and 9) that are urged upward by springs 33 disposed at the right and left side inner faces of the body housing 1, so that the transfer roller 14 is moved upward to press a lower surface (transfer region) of the photosensitive drum 13.

An upper wall 30*b* of the case 30 of the photosensitive member cartridge 3 covers an upper portion of the photosensitive drum 13. The light entrance portion 31, allowing Irradiation of an upper surface of the photosensitive drum 13 with laser light emitted from the laser scanning unit 7, is formed in the upper wall 30*b*, and is elongated in the directions of an axis the photosensitive drum 13. Disposed adjacent to the light entrance portion 31 is a charger 36, such as a scorotron or the like, that charges a photosensitive surface of the photosensitive drum 13 that is formed from an organic photosensitive material or the like.

An electrostatic latent image is formed on the surface of the photosensitive drum 13 by scanning laser light over the surface uniformly charged by the charger 36. After the electrostatic latent image is made visible (developed) by deposition thereon of a thin layer of toner supplied via the developing roller 22 (described later), the toner image is transferred to the sheet P in a press-transfer region defined by the photosensitive drum 13 and the transfer roller 14.

Figure 13:
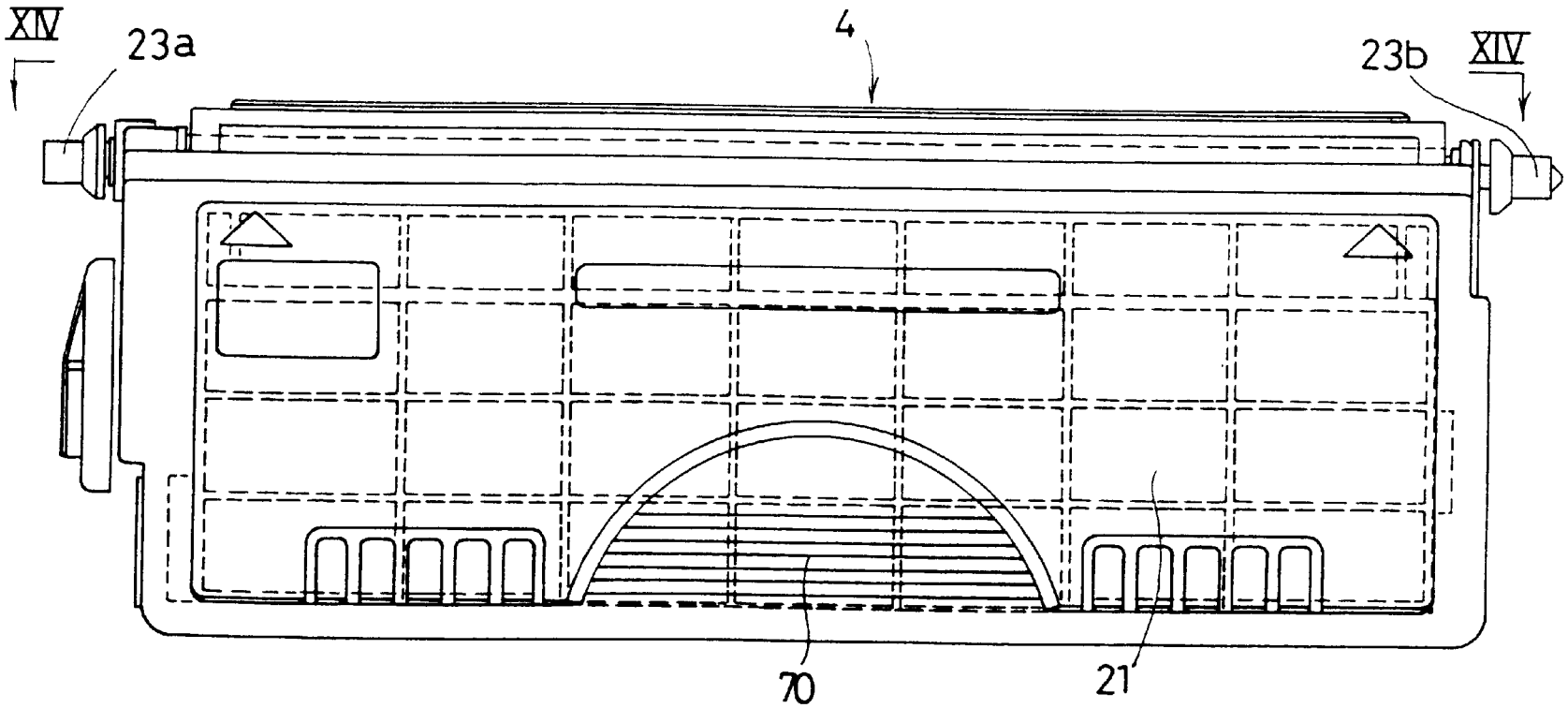
FIG. 13 is a plan view of the developer cartridge.
Figure 14:
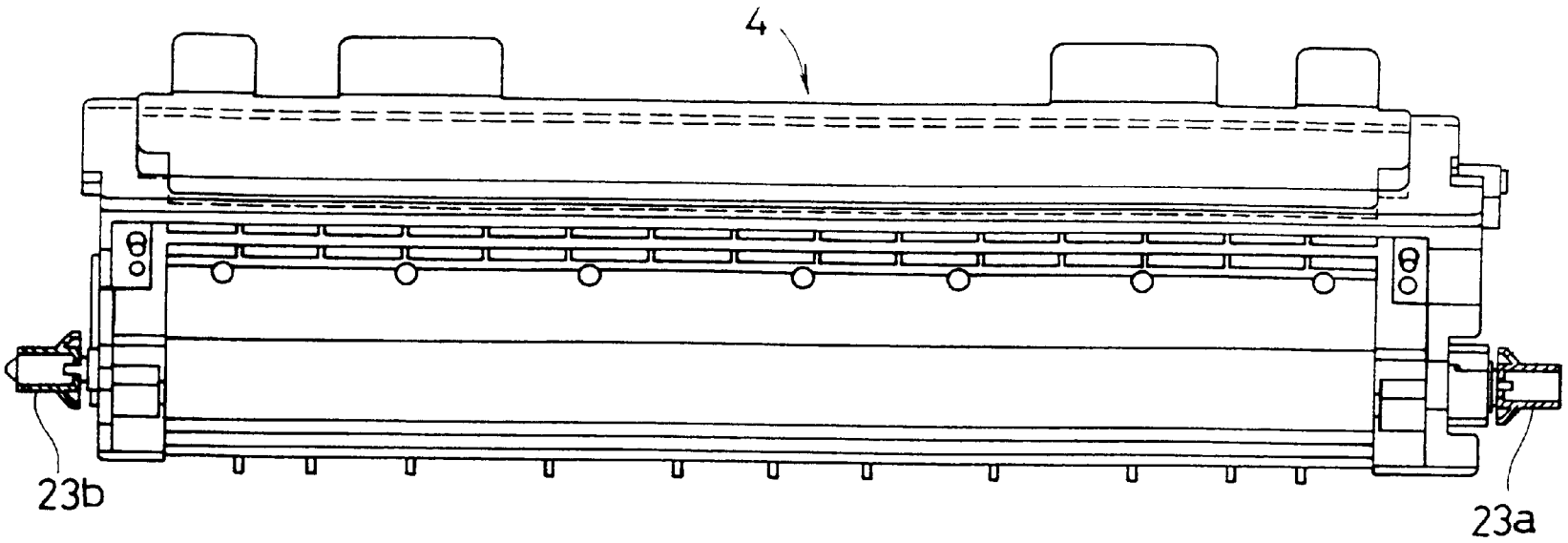
FIG. 14 is a view of the developer cartridge taken in the direction indicated by arrows XIV in FIG. 13.

A portion of the case 30 other than the upper wall 30*b* is open upward to define an accommodating portion 32 into which the developer cartridge 4 can be detachably set. An upper end face of each of right and left side walls 30*c* of the case 30 defines a downwardly arched guide groove 37 (guide device) to guide a corresponding one of bearings 23*a*, 23*b* (see FIGS. 13 through 15) fitted to both end portions of the developing roller shaft 22*a* of the developing roller 22 while supporting the bearing slidably. The guide grooves 37 extend toward a shaft 13*a* of the photosensitive drum 13. Therefore, when the developer cartridge 4 is set with respect to the photosensitive member cartridge 3, the developing roller 22 can be positioned adjacent to the photosensitive drum 13 so that they face each other (see FIG. 4).

In particular, when the developer cartridge 4 is connected to the photosensitive member cartridge 3, the bearings 23*a*, 23*b* contact and move along a first section of the guide grooves 37 in a direction that includes a vertical component. The bearings 23*a*, 23*b* then contact and move along a second section of the guide grooves 37 in a direction that is substantially horizontal. The difference of direction of movement of the bearings 23*a*, 23*b* is due to the arcuate shape of the guide grooves 37. Also, because of this arcuate shape, the bearings 23*a*, 23*b* move faster along the first section of the guide grooves than along the second section.

Figure 4:
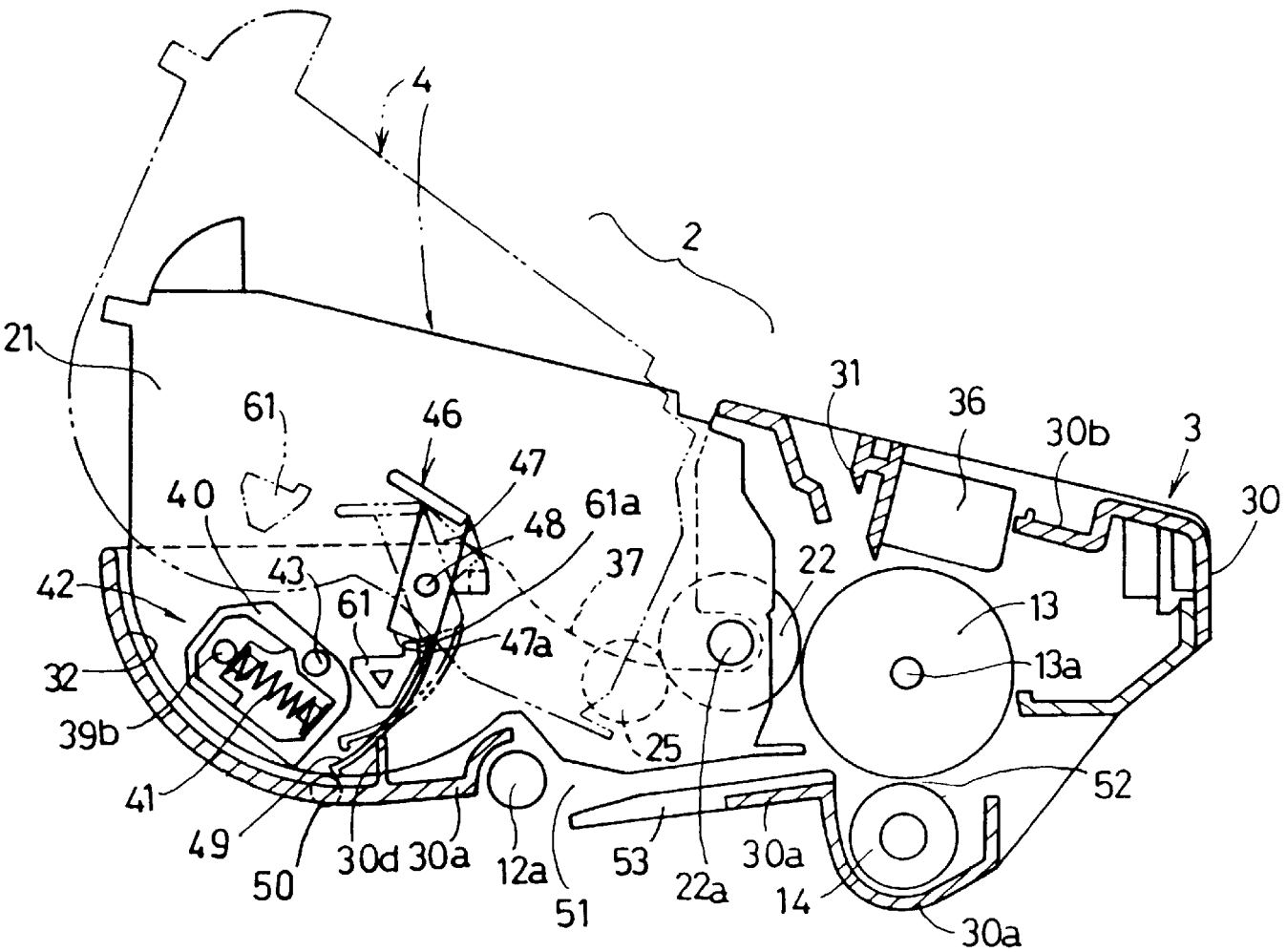
FIG. 4 is a side sectional view of the photosensitive member cartridge taken on plane IV—IV in FIG. 3.
Figure 10:
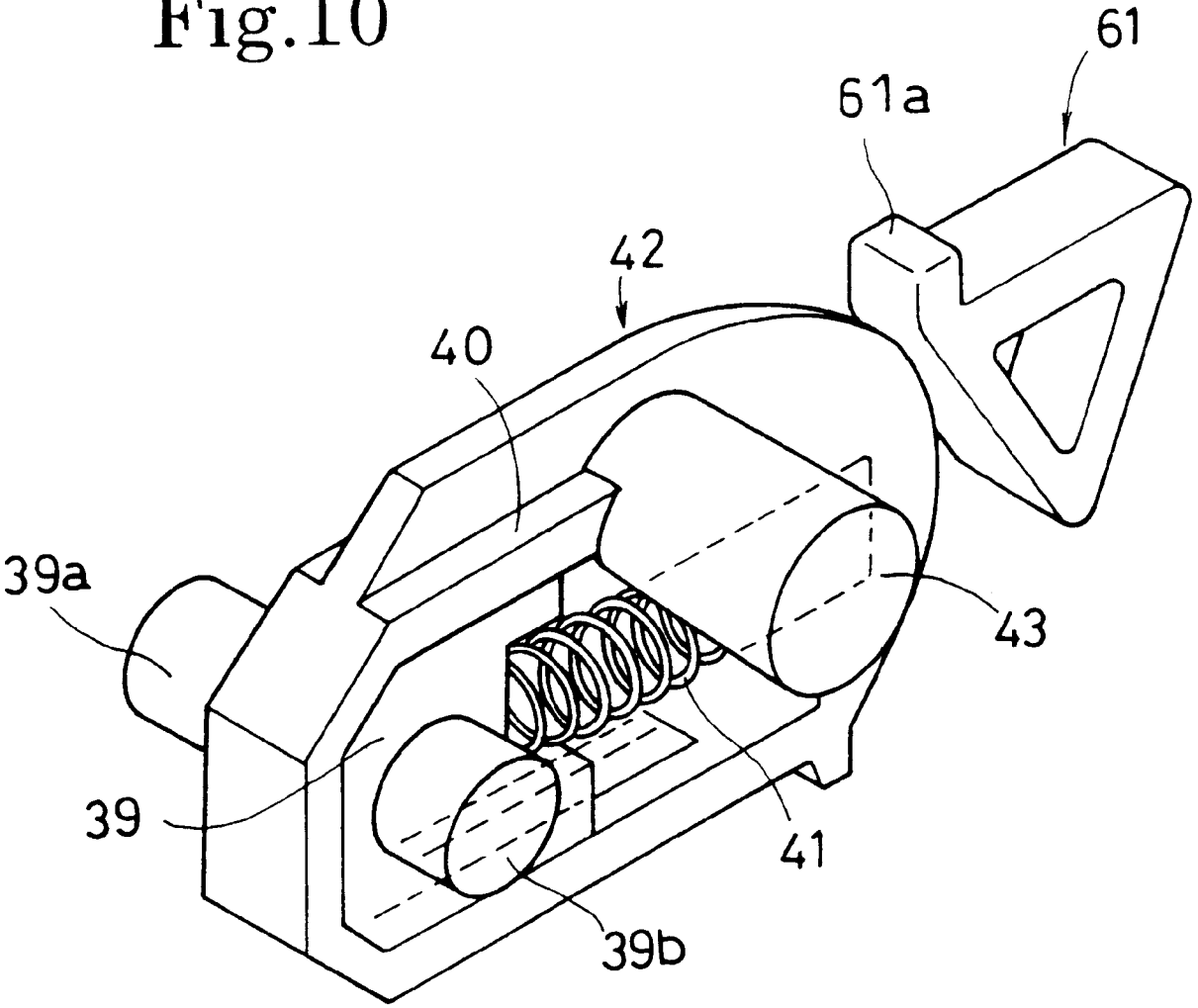
FIG. 10 is a perspective view of an urging device and an action-receiving portion.
Figure 11:
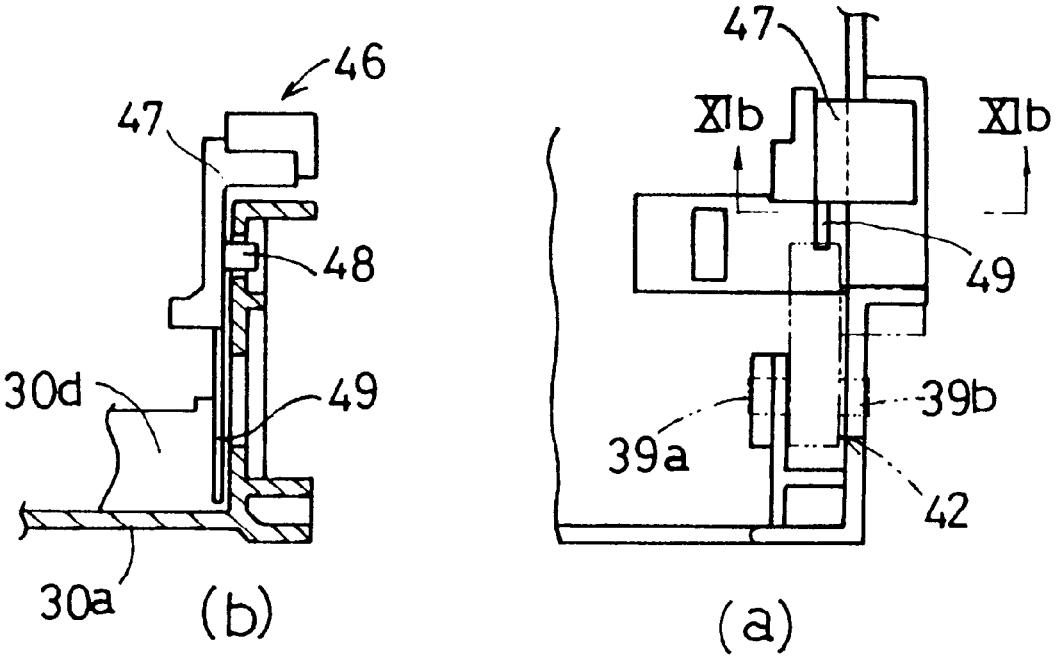
FIG. 11(*a*) is a plan view of a lock device.

An urging device 42 that presses the developing roller 22 against the photosensitive drum 13 via the developer cartridge 4 is pivotably and expandably mounted to an inner surface of each of the right and left side walls 30*c*. As shown in FIGS. 4 and 10, each urging device 42 has a pivot fulcrum member 39 provided with pivots 39*a*, 39*b* protruding integrally from the right and left sides thereof, a frame-like slide support member 40 that connects with and supports the pivot fulcrum member 39 that facilitates sliding movements therein, and an urging spring device 41, such as a coil spring or the like, that is disposed in the frame of the slide support member 40 so as to urge the pivot fulcrum member 39 toward one end. The slide support member 40 has a cylindrical motion acting portion 43 extending laterally. The motion acting portion 43 of each urging device 42 is disposed so that the portion 43 protrudes outward from a guide hole 44 formed in the corresponding one of the right and left side walls 30*c*.

The lock device 46 that prevents the developer cartridge 4, which is fitted into the accommodating portion 32, from moving upward out of the accommodating portion 32, is disposed at an inner side of one of the right and left side walls 30*c* (the right side wall in the embodiment) of the photosensitive member cartridge 3. As shown in FIGS. 4, 5, 11*a* and 11*b*, the lock device 46 is designed so that a rotating shaft 48 extending through the side wall 30*c* axially supports a lock lever 47 in such a manner that the lock lever 47 is pivotable relative to a side surface of the lock lever 47.

A resin-made spring 49 extending downward from a lower end of the lock lever 47 is disposed so that a lower portion of the resin-made spring 49 contacts a restriction piece 30*d* protruding upward from the bottom wall 30*a* of the case 30. A lower surface of the lock lever 47 has an arched contact portion 47*a* that restricts upward motion of one of action-receiving portions 61 (right-side one) protruding outward from the right and left side surfaces of the case 21 of the developer cartridge 4, by contacting an upper surface of the action-receiving portion 61. The action-receiving portions 61 have a generally inverted triangular shape in side view.

The action-receiving portions 61 are disposed so that they communicate with the lock device 46 and, furthermore, urging devices 42 that press the developing roller 22 against the photosensitive drum 13.

Figure 3:
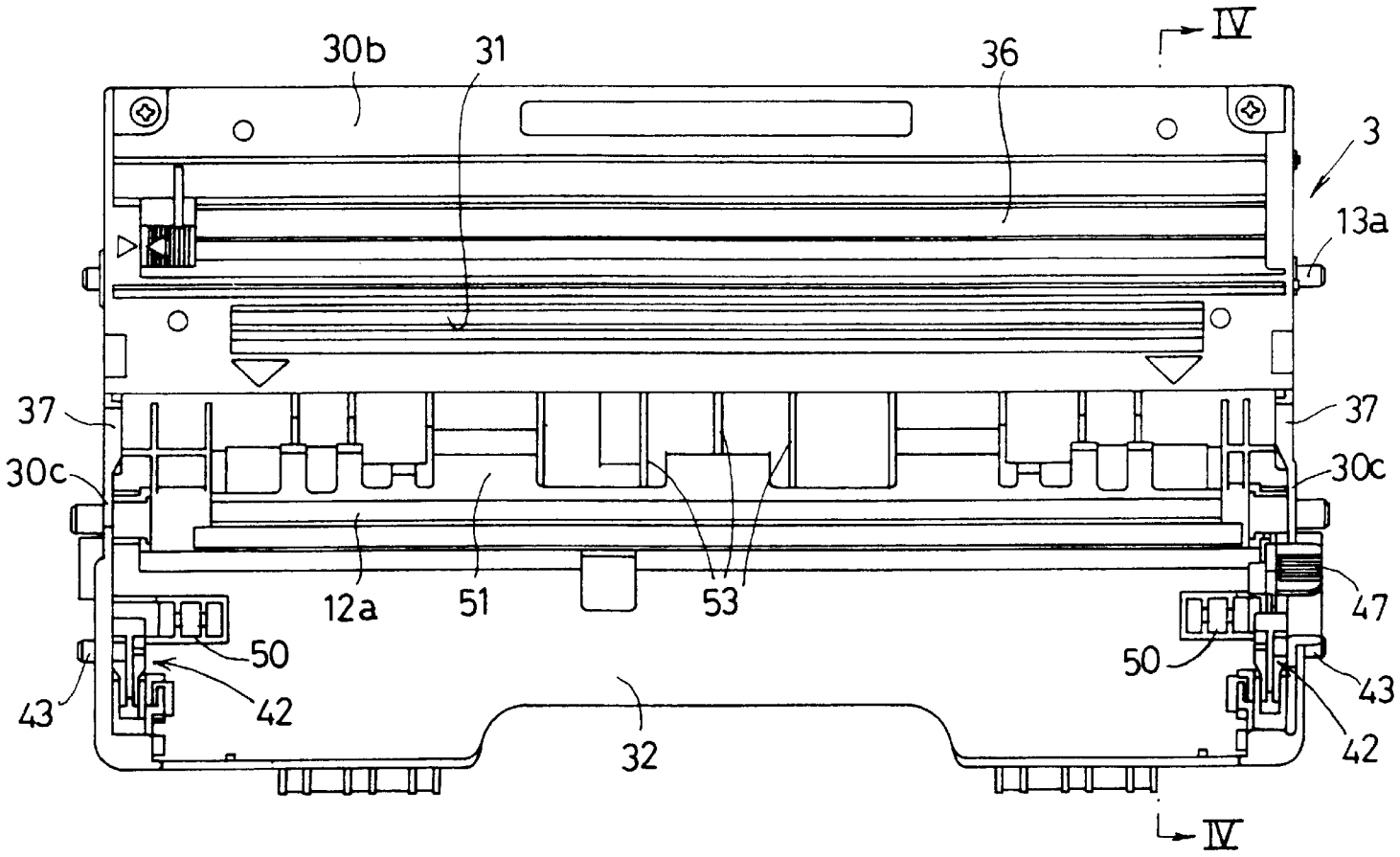
FIG. 3 is a plan view of a photosensitive member cartridge.
Figure 12A:
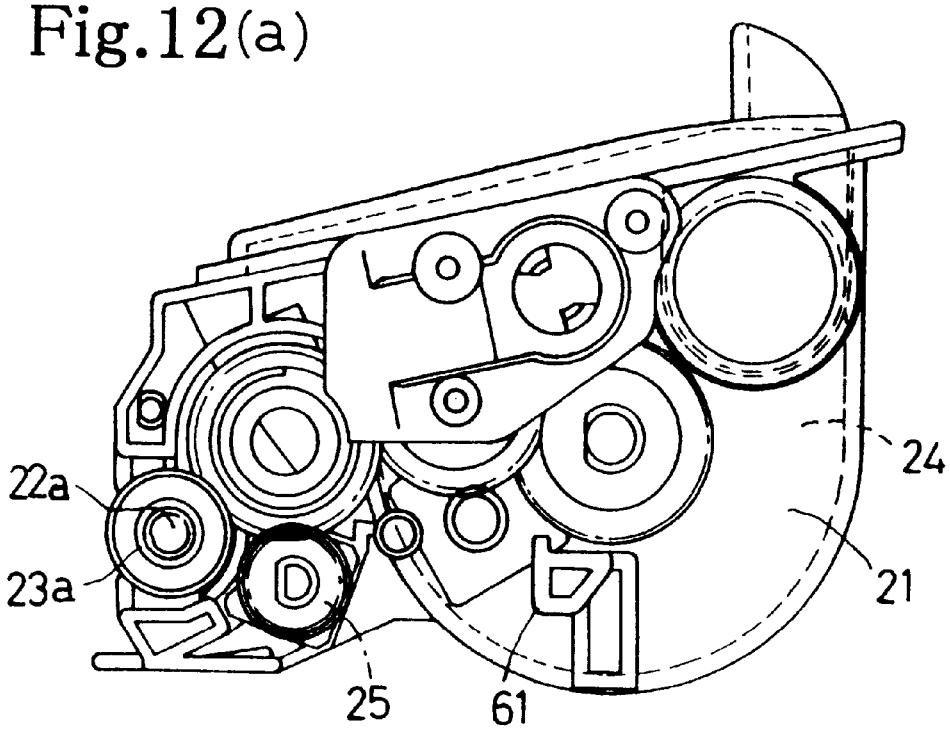
FIG. 12(*a*) is a left side view of a developer cartridge.
Figure 12B:
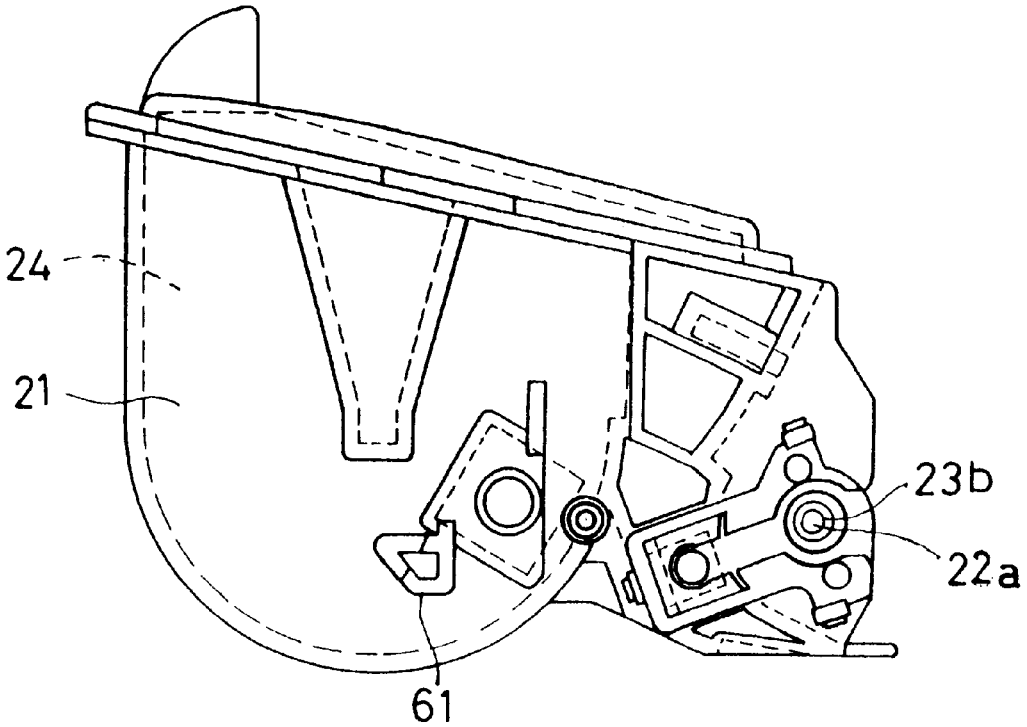

Rollers 50 are disposed, as receiving members, at a plurality of positions (two positions in the embodiment, that is, at right and left end portions) in the bottom wall 30*a* of the case 30, in the accommodating portion 32 of the photosensitive member cartridge 3 (see FIGS. 3 and 4). The rollers 50 protrude from the inner surface of the bottom wall 30*a*. When the developer cartridge 4 is inserted down into the accommodating portion 32, the rollers 50 (receiving device) receive a portion of the weight of the developer cartridge 4, at a side across the developing roller shaft 22*a* of the developing roller 22 from the photosensitive drum 13, that is, a side of the developing roller shaft 22*a* of the developing roller 22 opposite from the photosensitive drum 13. More specifically, the rollers 50 contact lower portions of a downward-convex curved surface of a toner containing chamber 24 (see FIGS. 1, 12*a* and 12*b*) provided in the case 21 of the developer cartridge 4, and the rollers 50 reduce the rattling of the case 21 during the setting or removing operation.

The upper roller 12*a* of the pair of register rollers is mounted to the bottom wall 30*a* of the case 30 of the photosensitive member cartridge 3 in such a manner that the upper roller 12*a* is prevented from detaching. The bottom wall 30*a* has a laterally elongated introduction hole 51 adjacent to the upper roller 12*a*, to introduce the sheet P from the pair of register rollers 12*a*, 12*b* into a transfer portion 52 between the photosensitive drum 13 and the transfer roller 14. The upper surface of a portion of the bottom wall 30*a* extending between the introduction hole 51 and the transfer portion 52 has many ribs 53 extending in a direction from the introduction hole 51 to the transfer portion 52. The ribs 53 are designed so that the sheet P can be smoothly conveyed with a reduced contact resistance on the lower surface of the sheet P.

The structure of the developer cartridge 4 will be described with reference to FIGS. 1, 12*a*, 12*b* and 13 through 15. After toner in the downward-convex toner containing chamber 24 in the case 21 is stirred by a rotationally driven stirrer 27 and discharged therefrom, toner is carried onto the outer peripheral surface of the developing roller 22 via a supply roller 25. A blade 26 is provided for restricting the layer thickness of toner on the developing roller 22 (see FIG. 1). The generally inverted triangular-shaped action-receiving portions 61 protrude from the right and left side outer ends of the toner containing chamber 24 in the case 21.

The developing roller 22 has a rubber roller formed by a substrate supported on the developing roller shaft 22*a* made of a metal, such as a stainless steel or the like. The rubber roller substrate is provided with electric conductivity by dispersing carbon black in a silicone rubber or a urethane rubber. The roller surface has a coating layer containing fluorine. The shaft bearings 23*a*, 23*b* rotatably fitted to the right and left end portions of the developing roller shaft 22*a* are formed from a material whose friction coefficient is small, such as an acetal resin or the like. Each of the bearings 23*a*, 23*b* has an engaging nail 62 that engages with an annular groove 63 so that the bearing will not detach from the shaft end. Each of the shaft bearings 23*a*, 23*b* has, at its base end side, an umbrella-shaped (conical) shaft diameter adjusting portion 64 whose diameter gradually increases.

Figure 15:
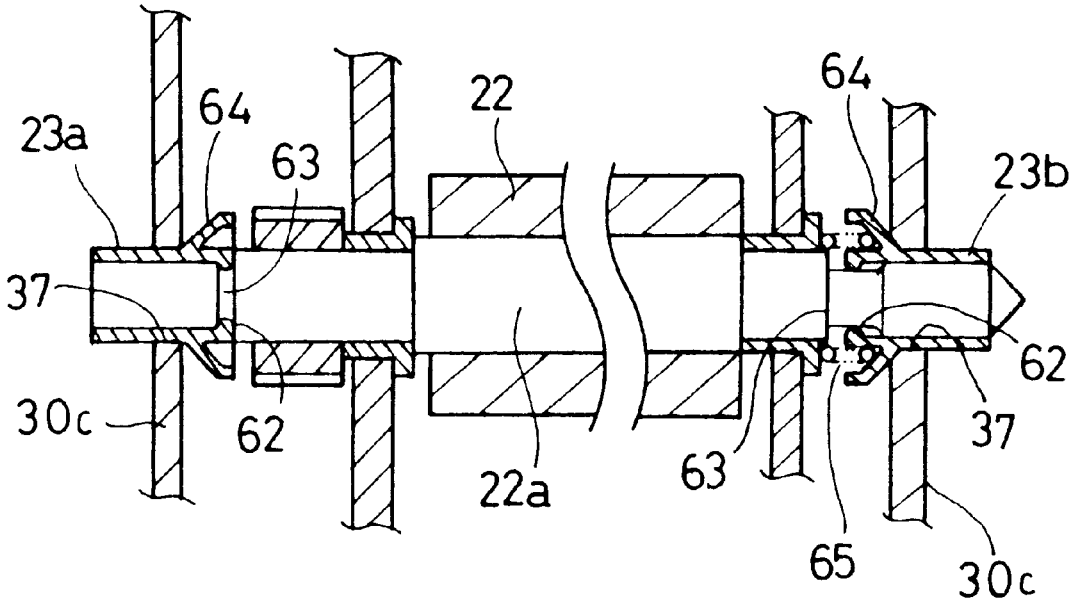
FIG. 15 is a sectional view of the developer cartridge, illustrating the structure of shaft bearings disposed at the right and left sides of the developer cartridge.

At least one of the shaft bearings 23*a*, 23*b* (the right-side bearing 23*b* in the embodiment) is slidingly urged laterally outward by a spring device 65 (see FIG. 15). Therefore, when the developer cartridge 4 is set at a predetermined position with respect to the photosensitive member cartridge 3, the developing roller shaft 22*a* of the developing roller 22 are supported, without rattling, on the guide grooves 37 formed in the right and left side walls 30*c* of the photosensitive member cartridge 3. Since both end portions of the developing roller shaft 22*a* serve as protrusions on both side ends of the developer cartridge 4 that engage with the guide grooves 37, the positioning or assembling precision can be improved and the production cost can be reduced. Furthermore, since the developing roller shaft 22*a*, extending through the case 21 of the developer cartridge 4, is made of a metal, the strength increases, so that breakage of the member becomes unlikely.

Figure 5:
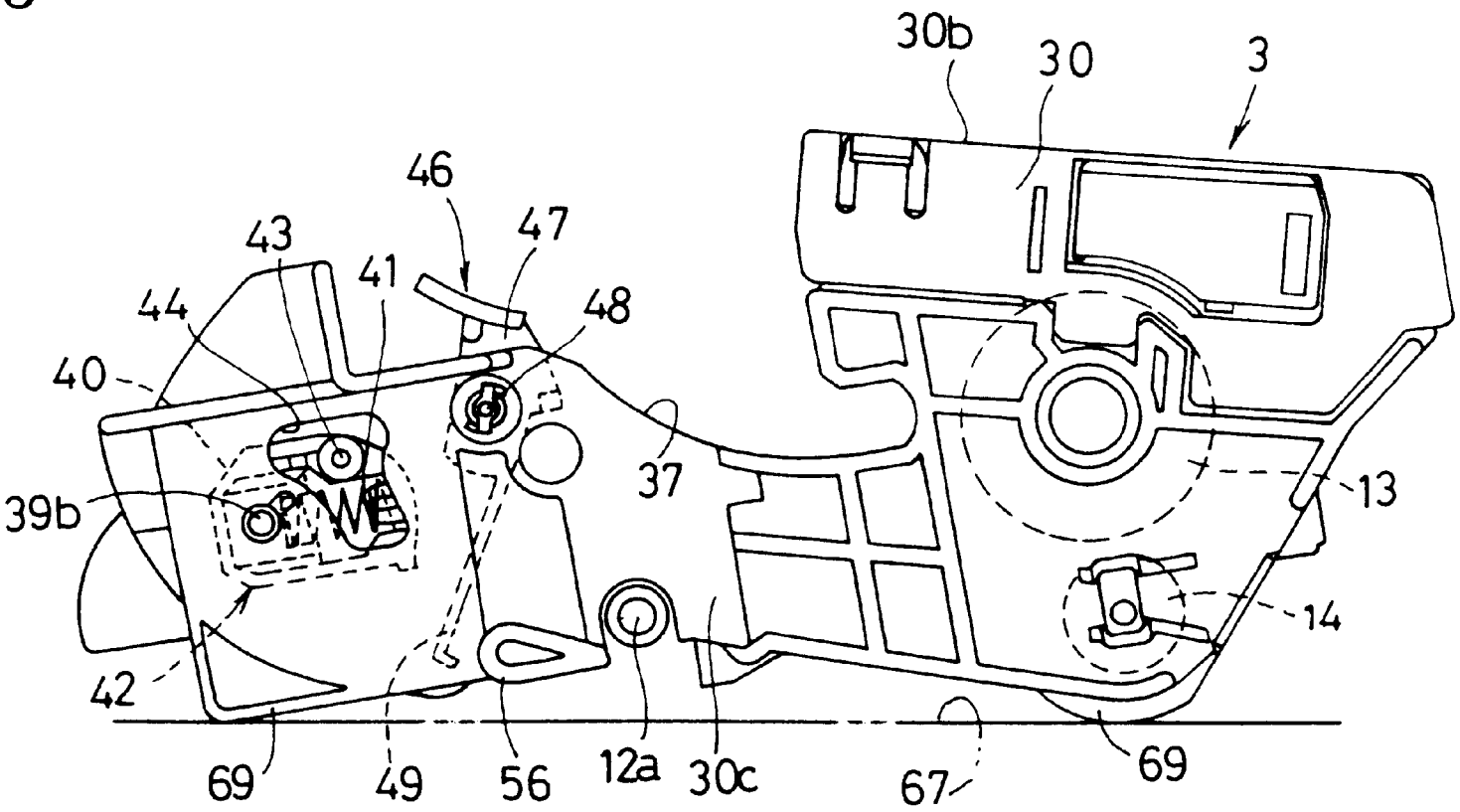
FIG. 5 is a right side view of the photosensitive member cartridge.
Figure 6:
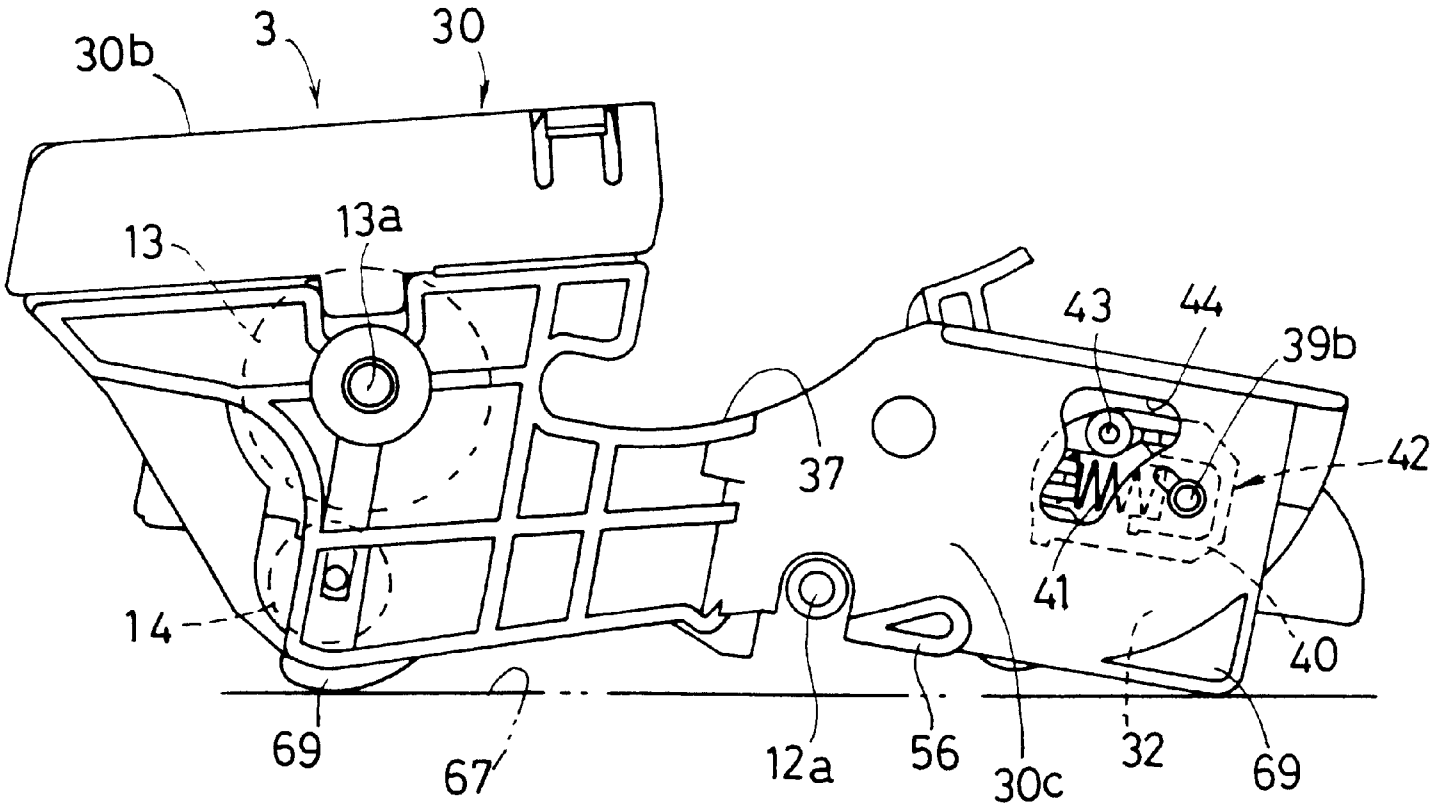
FIG. 6 is a left side view of the photosensitive member cartridge.
Figure 7:
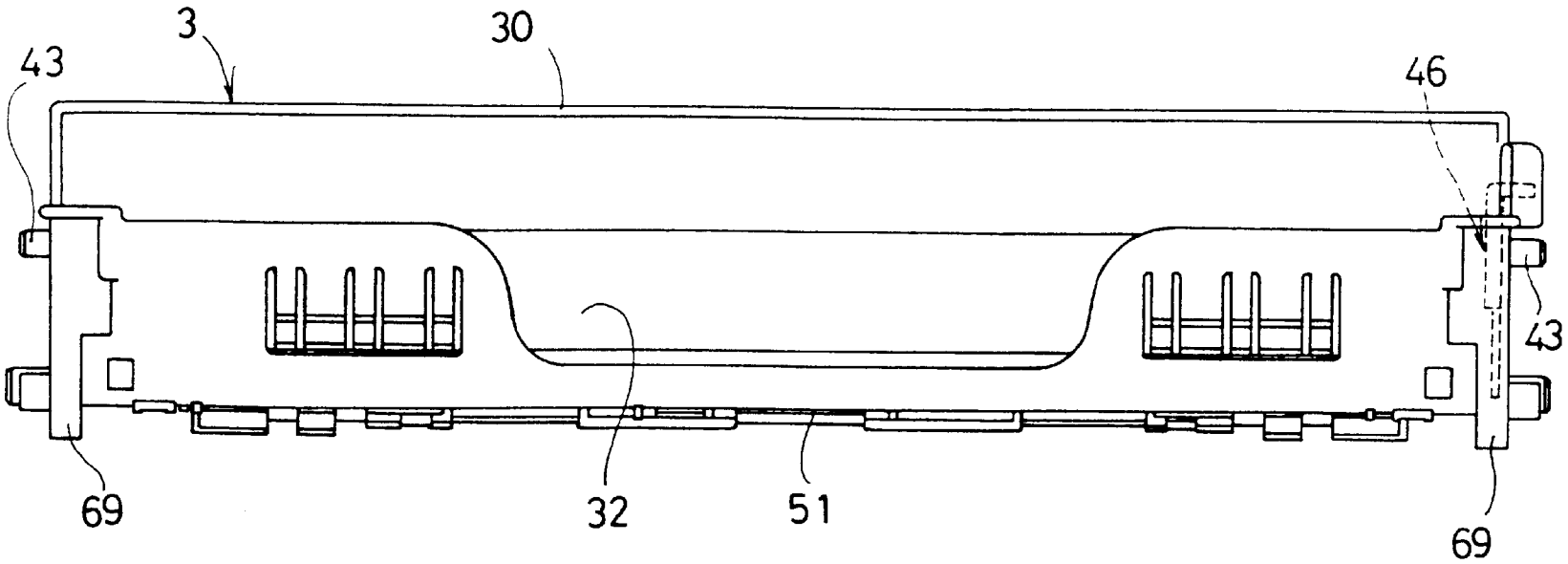
FIG. 7 is a front view of the photosensitive member cartridge.
Figure 16:
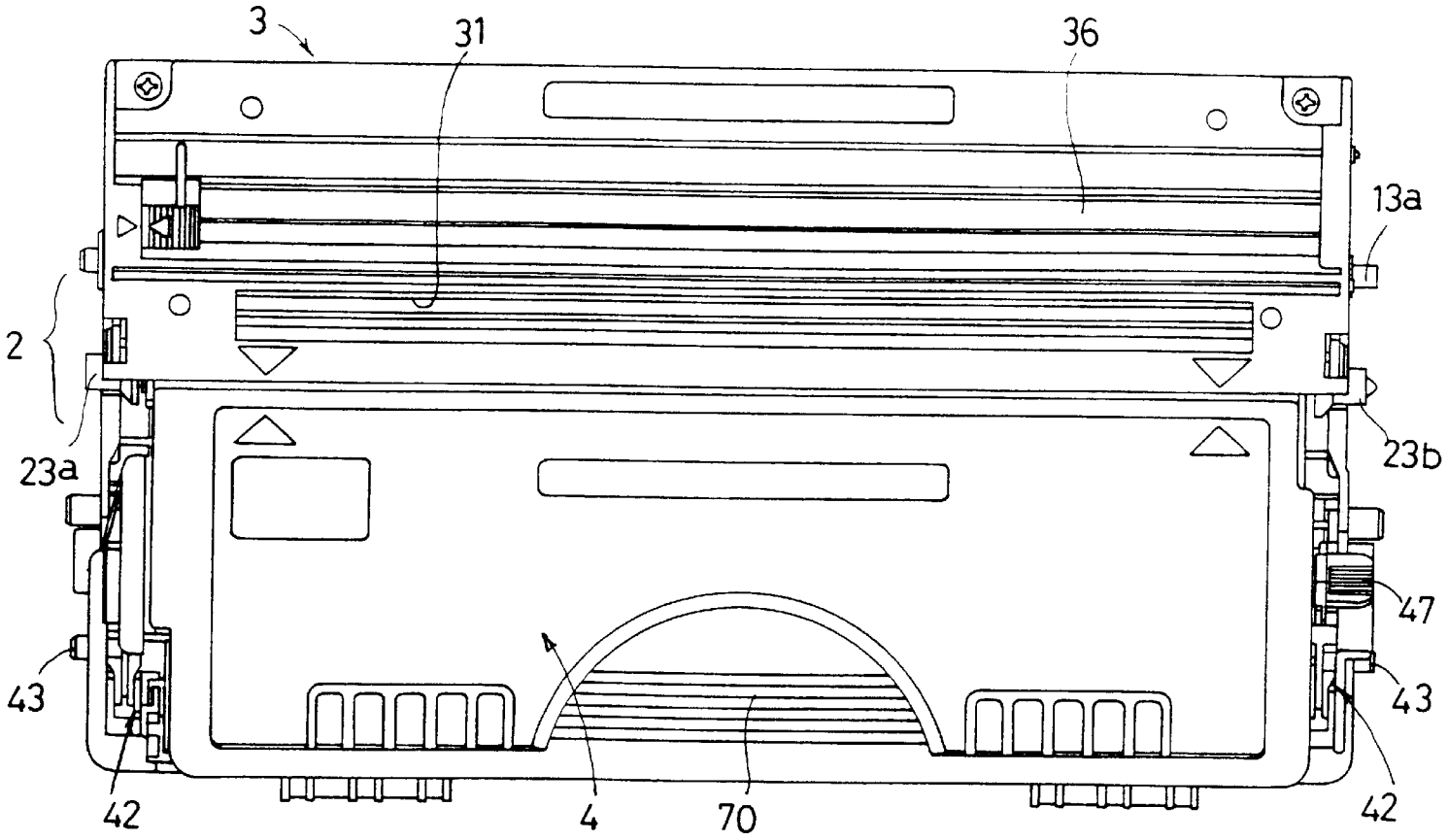
FIG. 16 is a plan view of a process unit.
Figure 17:
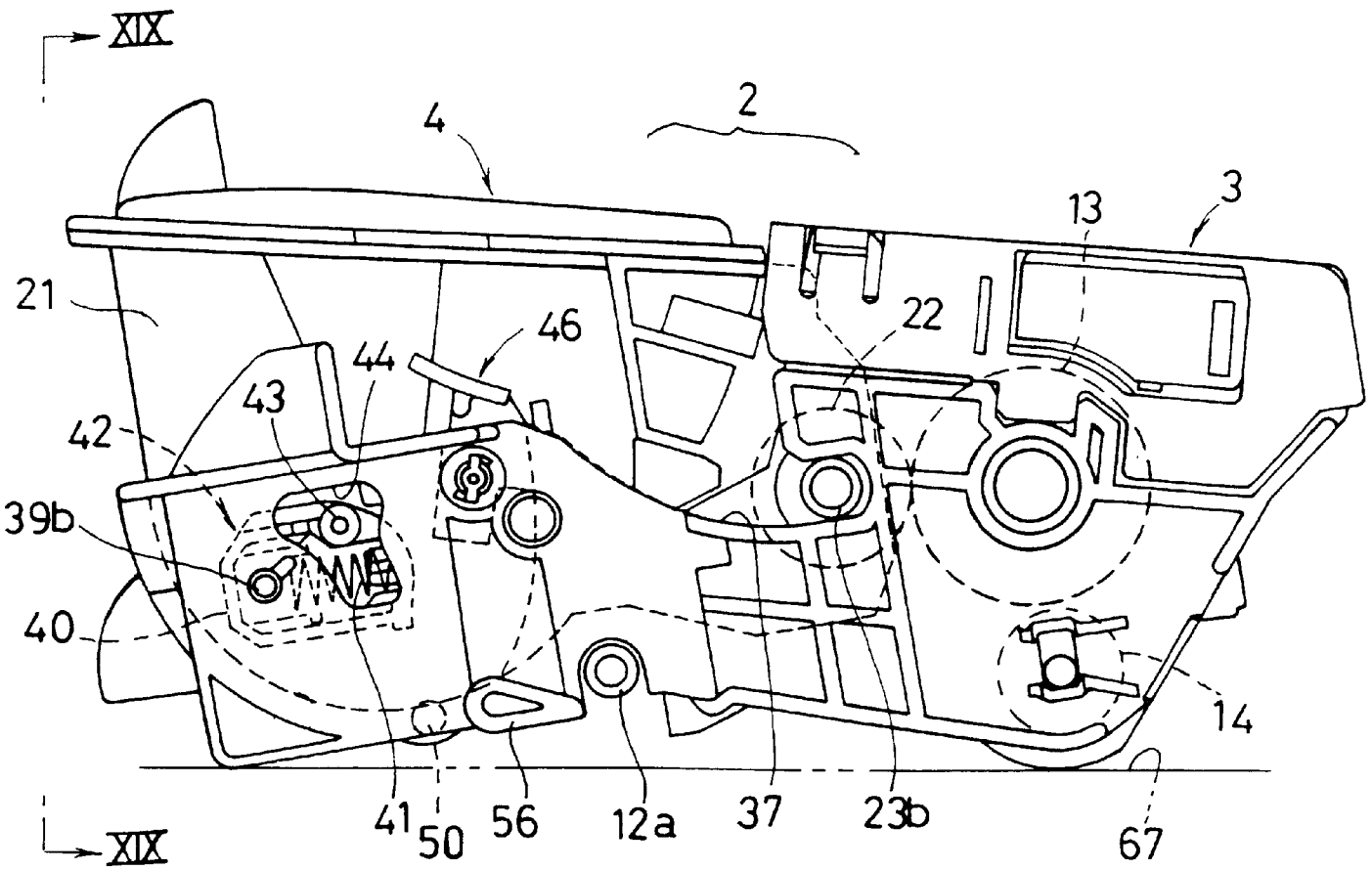
FIG. 17 is a right side view of the process unit.
Figure 18:
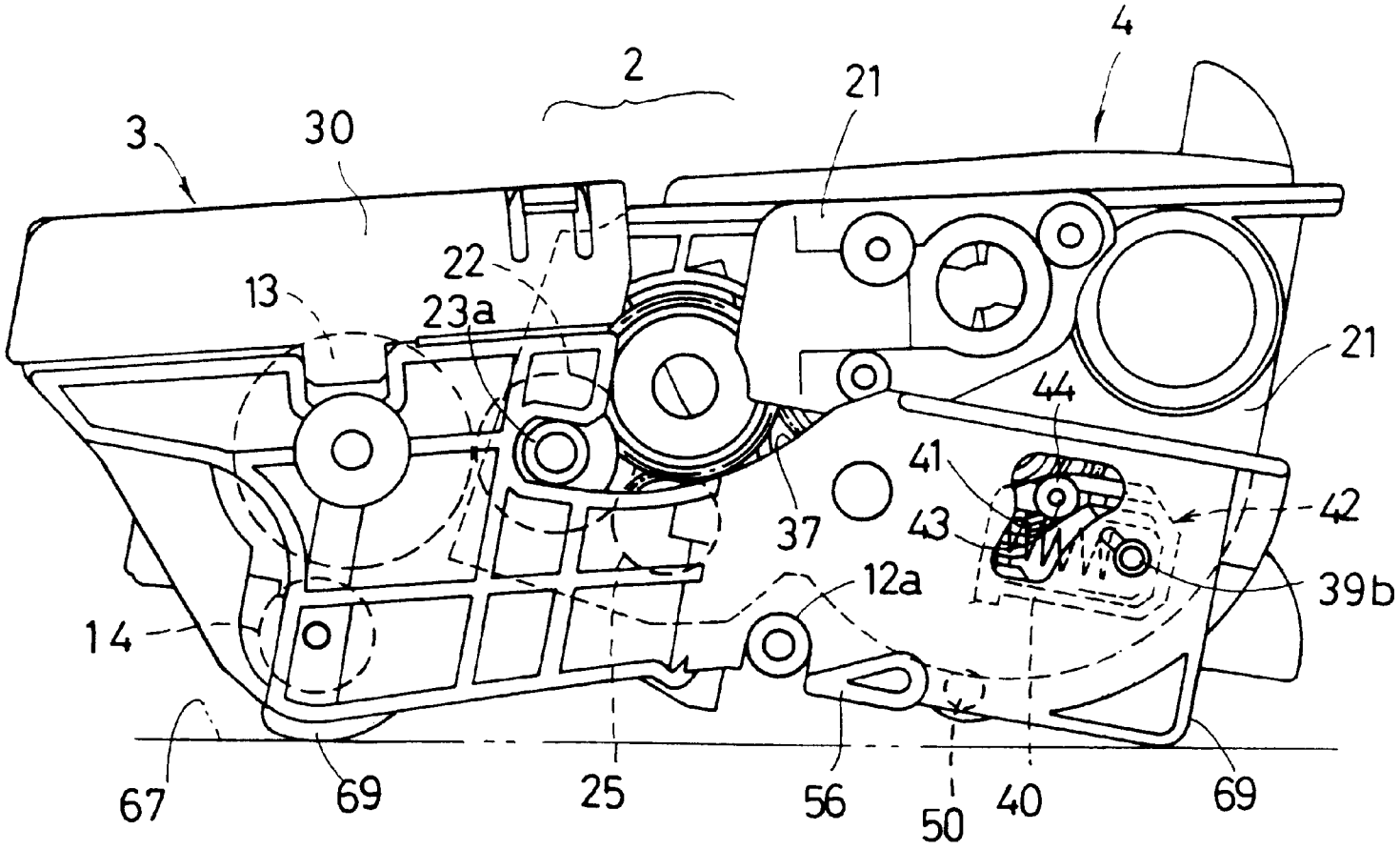
FIG. 18 is a left side view of the process unit.
Figure 19:
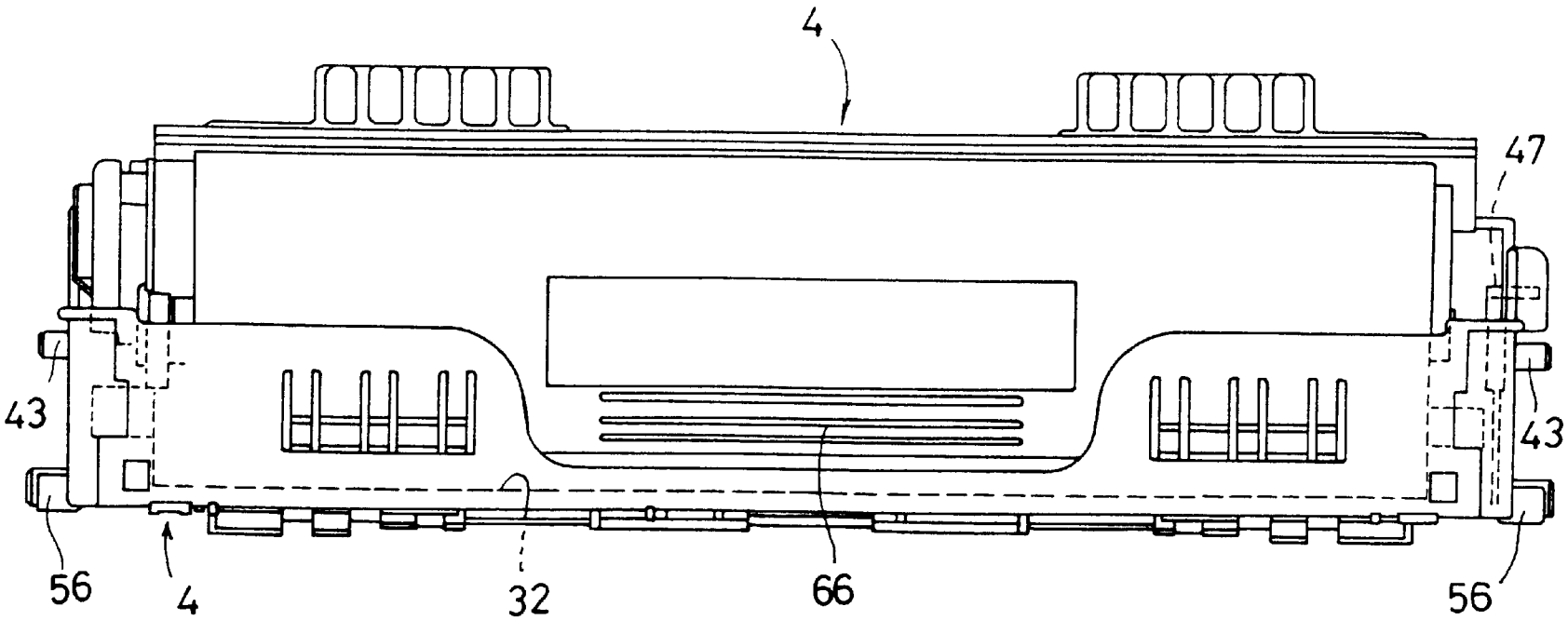
FIG. 19 is a view of the process unit taken in the direction indicated by arrows XIX in FIG. 17.

As shown in FIGS. 1, 16 and 19, the case 21 of the developer cartridge 4 has, in an upper surface portion and a lower surface portion thereof, grip portions 70, 66, respectively, that facilitate the handling of the developer cartridge 4, such as transportation thereof and the like. As shown in FIGS. 5 through 7, the case 30 of the photosensitive member cartridge 3 has foot portions 69 at a plurality of positions (at least two position and, preferably, four positions) that stabilize the photosensitive member cartridge 3 when it is placed on a table 67.

The operation of setting the developer cartridge 4 with respect to the photosensitive member cartridge 3 will be described. When the developer cartridge 4 inserted, with the developing roller 22 side being a leading side, into the upwardly open accommodating portion 32 provided in a rearward portion of the case 30 of the photosensitive member cartridge 3 (inserting operation), one of the action-receiving portions 61 of the developer cartridge 4 contacts the lock lever 47, and turns the lock lever 47 to a position indicated by a two-dot line in FIG. 4, against the force of the resin-made spring 49. When the developer cartridge 4 is thus inserted (the inserting operation is completed), the action-receiving portion 61 is lowered and, therefore, the contact between the action-receiving portion 61 and the lock lever 47 discontinues. Therefore, the lock lever 47 is returned to the position indicated by a solid line in FIG. 4, by the restoration force of the resin-made spring 49, so that the contact portion 47*a* of the lock lever 47 faces an upper surface of the action-receiving portion 61, thereby establishing a locked state.

During the insertion of the developing roller 22 into the accommodating portion 32, the shaft bearings 23*a*, 23*b* disposed at the right and left side ends of the developing roller 22 slide down along the guide grooves 37 formed along the upper edges of the right and left side walls 30*c* of the case 30, so as to approach the shaft 13*a* of the photosensitive drum 13. The case 21 of the developer cartridge 4 is pivotable about the bearings 23*a*, 23*b* of the developing roller shaft 22*a* of the developing roller 22 when the bearings 23*a*, 23*b* are supported by the guide grooves 37. Therefore, when the bearings 23*a*, 23*b* come to a position on the guide grooves 37 close to the shaft 13*a* of the photosensitive drum 13 ("U"-shaped portions of the guide grooves 37), a toner containing chamber 24 side portion of the case 21 of the developer cartridge 4 comes into the accommodating portion 32 of the photosensitive member cartridge 3 by a pivoting motion about the developing roller shaft 22*a* of the developing roller 22. Thus, the developer cartridge 4 is fittingly set in the accommodating portion 32.

In this state, the rollers 50 slidingly contact a lower surface portion of the case 21 on the side of the toner containing chamber 24, and the bearings 23*a*, 23*b* move along the guide grooves 37 to such a position that the developing roller 22 is located substantially closest to the photosensitive drum 13. When the lock lever 47 pivots clockwise to return from the position indicated by the two-dot line to the position indicated by the solid line in FIG. 4, the contact portion 47*a* of the lock lever 47 faces the upper surface (protrusion 61*a*) of the action-receiving portion 61, so that the developer cartridge 4 is prevented from moving out of the photosensitive member cartridge 3.

At least one of the shaft bearings 23*a*, 23*b* on the developing roller shaft 22*a* is urged by the spring device 65 in such a direction of the axis of the shaft that the conical jaw portion of the bearing is pressed against an inner side edge portion of the guide groove 37. In this manner, the bearings 23*a*, 23*b* are slid along the guide grooves 37. Therefore, even if there is some dimensional error between the distance between the bearings 23*a*, 23*b* and the distance between the guide grooves 37, the bearings 23*a*, 23*b* prevent the developer cartridge 4 from shifting or oscillating laterally relative to the photosensitive member cartridge 3 (in the directions of the axis of the developing roller 22).

Furthermore, since the bearings 23*a*, 23*b* are pivotable relative to the guide grooves 37, the bearings 23*a*, 23*b* of the developer cartridge 4 can be smoothly moved along the guide grooves 37, without the danger of being stopped on the grooves 37, when the developer cartridge 4 is to be set with respect to photosensitive member cartridge 3 or removed therefrom.

FIGS. 16 through 19 are a plan view, a right side view, a left side view, and a rear view (a view of the side of the sheet discharge opening) of the process unit 2 with the developer cartridge 4 set with respect to the photosensitive member cartridge 3. Since the urging devices 42 are pressed downward by the action-receiving portions 61 as the developer cartridge 4 is pushed downward into the process unit 2, each urging device 42 normally assumes such a posture that the motion acting portion 43 is relatively lowered, as shown in FIGS. 2 and 4.

The process unit 2 is designed so that the process unit 2 can be set into, and removed from, the body housing 1 when a lid 1*b* provided in the right-side end in FIG. 1 (a front face) of the body housing 1 is downwardly turned to form a large opening (see FIG. 2).

That is, as shown in FIGS. 2, 20*a*, 20*b* and 21, a pair of right and left guide devices 55, made of a resin or the like, are fixed to the inner surfaces of the right and left side portions of the body housing 1 (in the drawings, only the right-side guide device 55 is shown). Each guide device 55 has a rising slope surface that is open upward and extends upwardly inward from the right-side end of the body housing 1, and an upper-side guide surface 55*a* extending downwardly inward from a summit 55*d* of the rising slope surface, and a lower-side guide surface 55*b* that is disposed below the upper-side guide surface 55*a* and that extends downwardly inward from the right-side end of the body housing 1, and ends at a position near the lower roller 12*b* of the pair of register rollers.

Figure 20A:
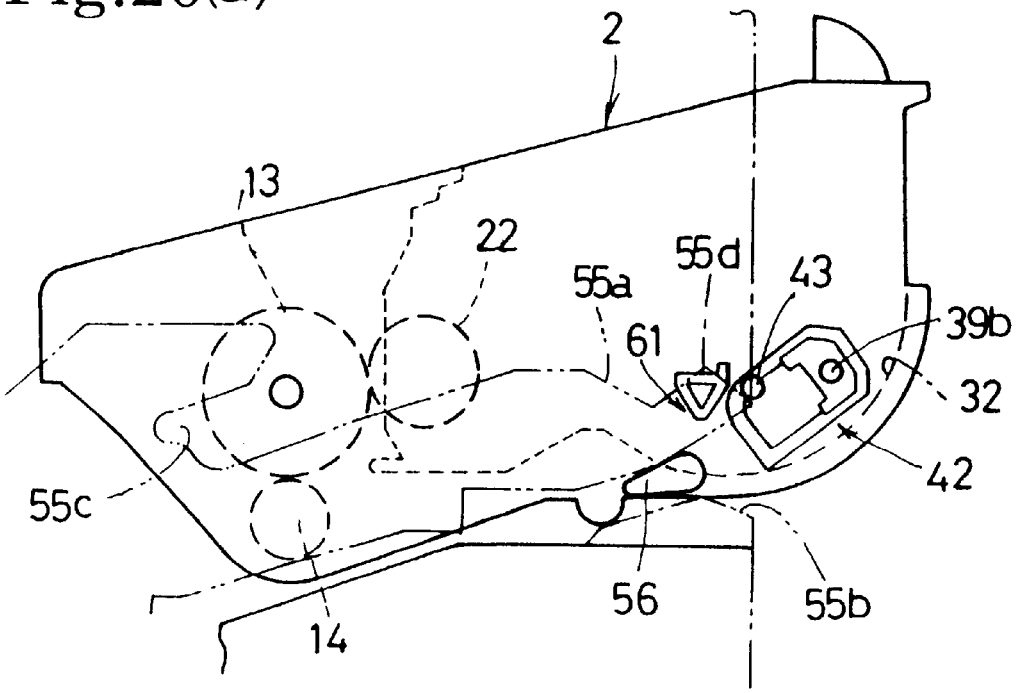
FIG. 20(*a*) illustrates a situation in which the process unit is being inserted into the body housing.
Figure 20B:
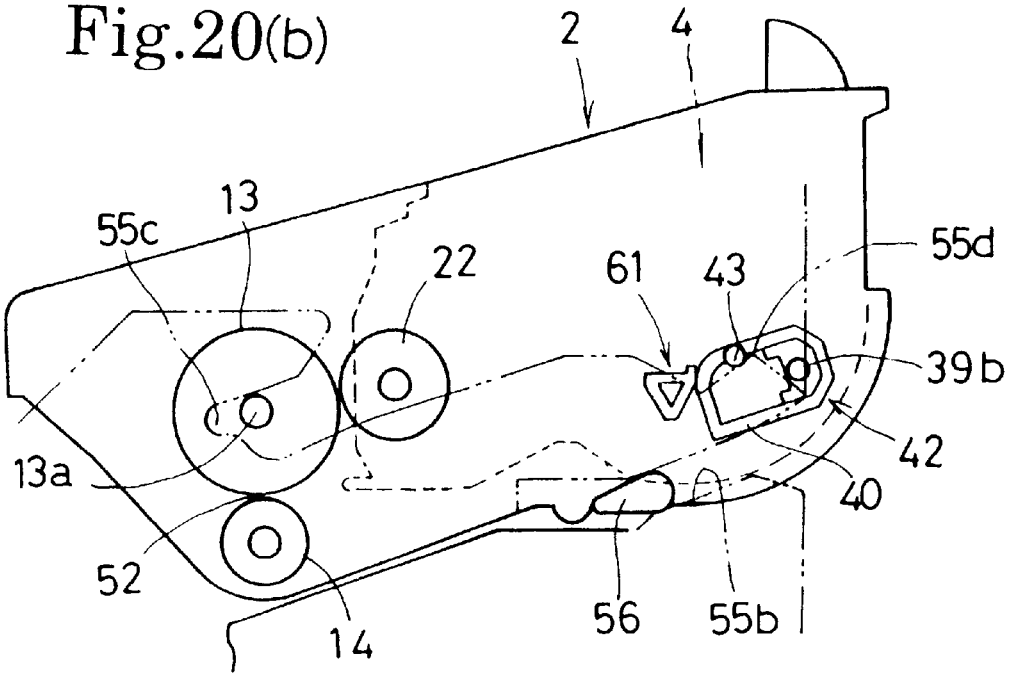

FIG. 2 indicates a position at which the insertion of the process unit 2 into the body housing 1 is started. The process unit 2 is inserted into the body housing 1 so that the shaft 13*a* of the photosensitive drum 13 approaches an upper inward end portion 55*c* of the upper-side guide surface 55*a*. Subsequently, as shown in FIG. 20*a*, the motion acting portion 43 of each urging device 42 contacts the rising slope surface of the upper-side guide surface 55*a*, and each of guiding members 56, protruding laterally from lower portions of the right and left sides of the process unit 2 (photosensitive member cartridge 3), fits into the lower-side guide surface 55*b* (only one of the guiding members 56 is shown in the drawings), so that the process unit 2 is prevented from moving upward relative to the body housing 1, and is allowed only to be moved further inward along the lower-side guide surface 55*b*.

In this state, as the process unit 2 is pushed inward, the motion acting portion 43 of each urging device 42 is raised by the corresponding upper-side guide surface 55*a*, so that the slide support member 40 of each urging device 42 pivots upward about the pivots 39*a*, 39*b*. Therefore, the slide support member 40 of each urging device 42 restrains the corresponding one of the action-receiving portions 61 of the developer cartridge 4 in such a direction that a distal end portion of the slide support member 40 pushes the action-receiving portion 61. When the motion acting portion 43 of each urging device 42 comes to the summit 55*d* of the upper-side guide surface 55*a*, the slide support member 40 of each urging device 42 is pivoted to a most upward posture. In this posture, the distal end portion of the slide support member 40 of each urging device 42 keeps restraining the corresponding action-receiving portion 61 (see FIG. 20*b*).

As the process unit 2 is pushed further inward, the shaft 13*a* of the photosensitive drum 13 is set to a predetermined position in the inward end portion 55*c* of each upper-side guide surface 55*a*. At this position, an operator releases the process unit 2 from the operator's hands, so that the developer cartridge 4 side portion of the process unit 2 is lowered and set by the weight the process unit 2 into a state such that the upper register roller 12*a* disposed at a lower surface side of the case 30 of the photosensitive member cartridge 3 is placed on the lower register roller 12*b* disposed in the body housing 1, and is pressed by a spring 45, shown in FIG. 2 and, simultaneously, the guiding members 56 are supported at appropriate positions on the guide devices 55 (see FIG. 21).

When the process unit 2 is set as described above, the distal end of the slide support member 40 of each urging device 42 presses the corresponding action-receiving portion 61. Therefore, the developing roller 22 is pressed against the photosensitive drum 13 by the urging devices 42 and the action-receiving portions 61 via the developer cartridge 4.

Figure 21:
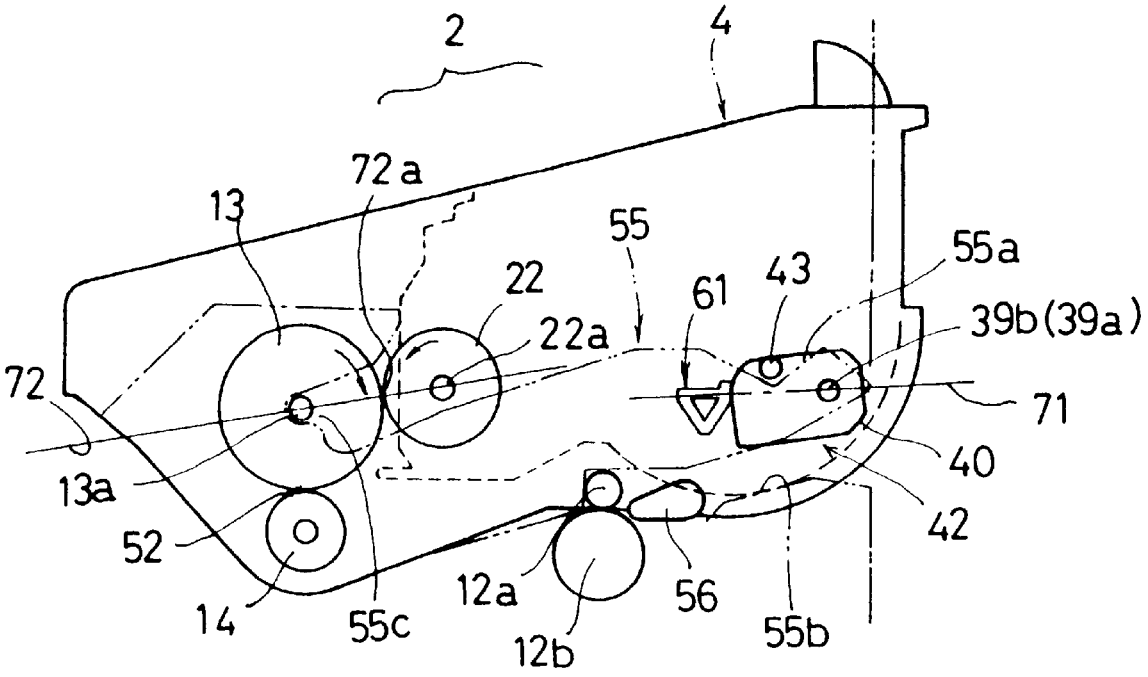
FIG. 21 illustrates a situation in which the process unit has been set in the body housing.

As shown in FIG. 21, it is preferable that a contact portion 72*a* between the photosensitive drum 13 and the developing roller 22, that is, pressed portions thereof at the closest positions, (the contact portion 72*a* is on an inter-axis straight line 72 passing through the axis of the shaft 13*a* of the photosensitive drum 13 and the axis of the developing roller shaft 22*a* of the developing roller 22) be above or on a pressing action line 71 of the action of either one of the urging devices 42 onto the corresponding action-receiving portion 61 (that is, a straight line passing through the pivot 39*a* (39*b*) and a pressing point at which the distal end of the slide support member 40 contacts the action-receiving portion 61), or that the inter-axis straight line 72 substantially coincide with or extend substantially parallel to the pressing action line 71.

Figure 22:
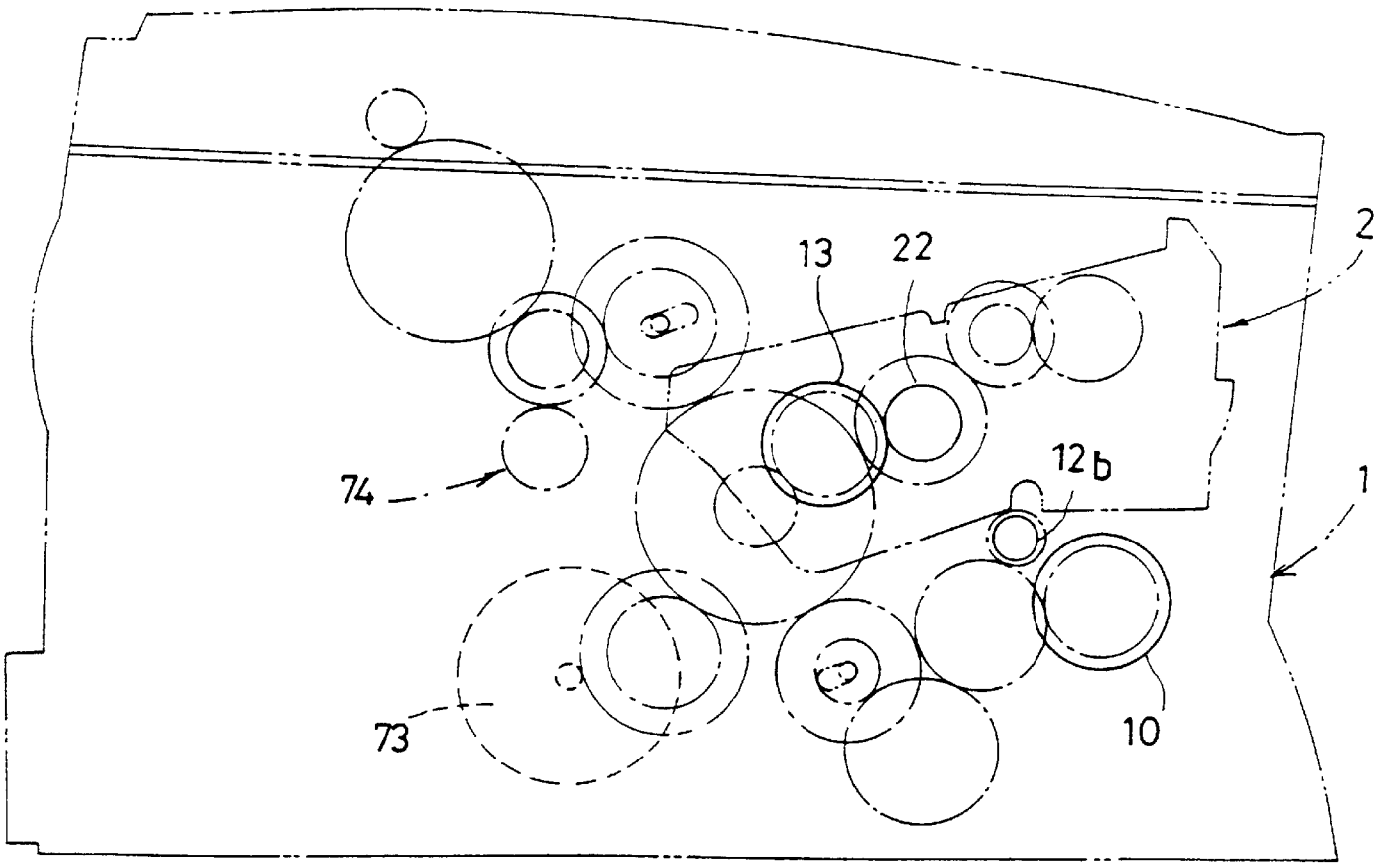
FIG. 22 is an illustration of a drive system of the printer.

As shown in FIG. 22, a gear mechanism 74 that transmits force from a drive motor 73 is disposed on the inner surface of one side (the left side in the embodiment) of the body housing 1. The gear mechanism 74 rotates the sheet feed roller 10 of the sheet feeder 6, the lower register roller 12*b*, the developing roller 22, the photosensitive drum 13, the heat roller 15, and conveying rollers in the sheet discharge passage. The developing roller 22 and the photosensitive drum 13 are rotated in opposite directions, as indicated in FIGS. 1 and 21, that is, the developing roller 22 is rotated counterclockwise and the photosensitive drum 13 is rotated clockwise. Furthermore, the mechanism is designed so that the circumferential velocity of the developing roller 22 is greater than that of the photosensitive drum 13.

Figure 23:
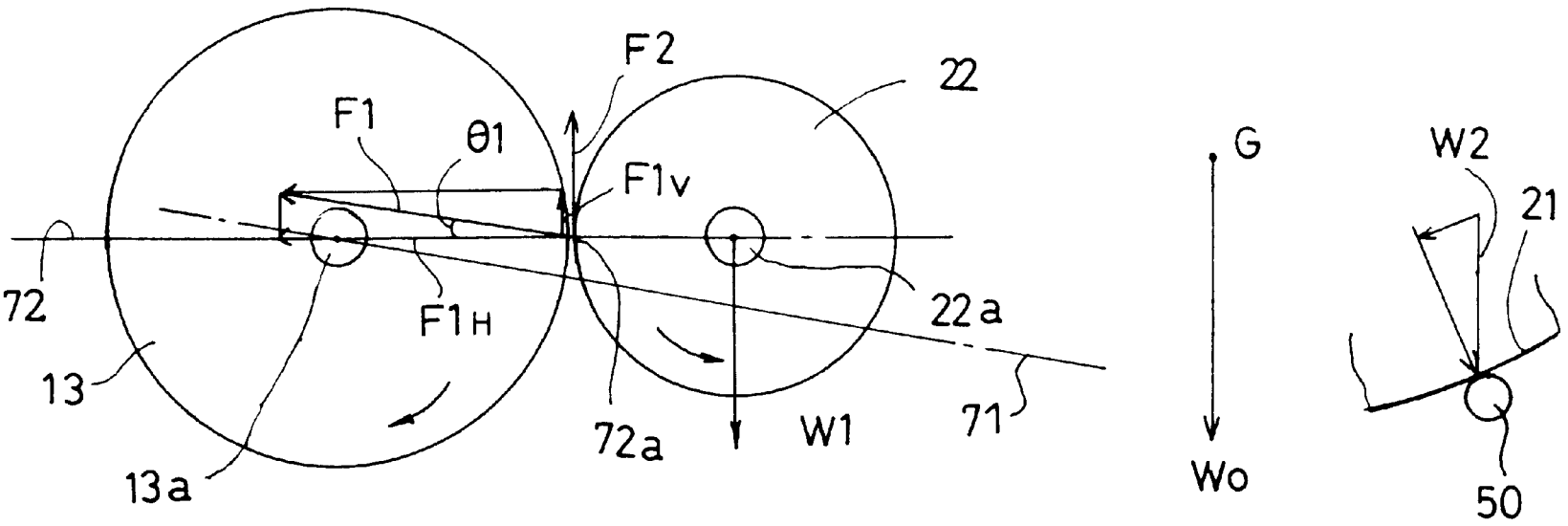
FIG. 23 is an illustration of a force that presses a developing roller against a photosensitive drum and other forces concerned.

Therefore, as shown in FIG. 23, during image forming operation, the direction of a pressing force F1 of each urging device 42 acting on the contact portion 72*a* is parallel to the pressing action line 71, and the pressing force F1 is split into a component F1V in a direction of the tangent of the circumferences of the developing roller 22 and the photosensitive drum 13 and a component F1H in a direction of the inter-axis straight line 72.

The difference in circumferential velocity between the developing roller 22 and the photosensitive drum 13 creates a friction resistance force F2 in an upward direction in FIG. 23 with respect to the developing roller 22 and in a downward direction with respect to the photosensitive drum 13, the friction resistance force F2 having a value equal to a multiplication product of the friction coefficient and the component F1H of the pressing force in the direction of the inter-axis straight line 72 of the photosensitive drum 13 and the developing roller 22. Therefore, the rotation moment caused by the friction resistance force F2 acting on the developer cartridge 4 acts about the developing roller shaft 22*a* in a clockwise direction in FIG. 23.

If the pressing action line 71 extends above the developing roller shaft 22*a*, a rotation moment acts on the developer cartridge 4 about the developing roller shaft 22*a* counter clockwise in FIG. 23, and reduces or offsets the rotation moment caused by the friction resistance force F2. In such a case, the developer cartridge 4 tends to rise, which is unfavorable. In this invention, however, the position of the developing roller shaft 22*a* is above or on the pressing action line 71, or the inter-axis straight line 72 substantially coincides with, or extend substantially parallel to, the pressing action line 71. Therefore, during image formation, the developing roller 22 is substantially prevented from rising, and stable pressing action can be achieved.

Furthermore, the pressing structure is formed by the urging devices 42 for pressing the developing roller 22 against the photosensitive drum 13, and the action-receiving portions 61 provided on the developer cartridge 4. The action-receiving portions 61 are disposed at a side of the developing roller 22, the side being remote from the photosensitive drum 13. Therefore, the photosensitive drum 13, the developing roller 22 and the drive mechanisms will not become impediments, and the pressing action line 71 and the inter-axis straight line 72 can easily be set substantially parallel to each other and adjacent to each other.

If the developer cartridge 4 is supported pivotably about the developing roller shaft 22*a* of the developing roller 22 while image forming operation is being performed, with the developer cartridge 4 set with respect to the photosensitive member cartridge 3, that is, if the arrangement is set such that during image forming operation, the bearings 23*a*, 23*b* on both ends of the developing roller shaft 22*a* of the developing roller 22 are stopped at the inward sides of the guide grooves 37 of the photosensitive member cartridge 3 and therefore prevented from moving further inward, and the weight Wo of the developer cartridge 4 is dispersedly supported at two positions in a side view, that is, the position of the shaft bearing 23*a* (23*b*), and a position at a side of the developing roller shaft 22*a* remote from the photosensitive drum 13, for example, a position at which the bottom of the toner containing chamber 24 contacts the rollers 50, or the like, so that split loads W1, W2 of the weight Wo are supported at the two positions (see FIG. 23), then the direction of the rotation moment about the axis (the developing roller shaft 22*a*) of the developing roller 22 caused by the friction resistance force F2 received by the developing roller 22 from the photosensitive drum 13 becomes the same as the direction of the rotation moment about the axis (the developing roller shaft 22*a*) of the developing roller 22 caused by the weight (load Wo at the center of gravity G) of the developer cartridge 4, that is, the clockwise direction in FIG. 23. Therefore, during image forming operation, the aforementioned friction resistance force F2 does not act as a moment in such a direction as to raise the developer cartridge 4 against the weight (load Wo at the center of gravity G) of the developer cartridge 4, so that the behavior of the developer cartridge 4 stabilizes.

Furthermore, the direction of the rotating drive force transmitted to the developing roller shaft 22*a* of the developing roller 22 from the gear mechanism 74 is clockwise in FIG. 23. Therefore, the rotation moment (torque) caused by the rotating drive force acts in the same direction as the rotation moments caused by the friction resistance force F2 and the weight of the developer cartridge 4, so that the behavior of the developer cartridge 4 stabilizes. Further, the friction resistance force F2 only has a component as a rotation moment about the developing roller shaft 22*a*, so that even if the friction resistance force F2 fluctuates, the force pressing the developing roller 22 against the photosensitive drum 13 remains unchanged. Thus, stable developing operation can be accomplished.

In the above-described structure, the urging devices 42 are disposed at positions that are within the accommodating portion 32 in the photosensitive member cartridge 3, and that become remote from the developing roller 22 of the developer cartridge 4 when the developer cartridge 4 is set in the accommodating portion 32. The action-receiving portions 61 protrude outward from outer walls of the developer (toner) containing chamber 24, which is disposed at a side remote from the developing roller 22. Therefore, these component parts are unlikely to interfere with the operations of inserting or removing the developer cartridge 4.

In the embodiment of the invention, the urging devices 42, having a relatively complicated structure, are disposed in the photosensitive member cartridge 3, which requires less frequent replacement. The action-receiving portions 61, having a relatively simple structure, are disposed in the developer cartridge 4, which requires frequent replacement. Therefore, the production costs of the process unit 2 and the developer cartridge 4 can be reduced, and the running cost can be reduced. Furthermore, since the protruded action-receiving portions 61 provided on the developer cartridge 4 are integral with the side surfaces of the case 21, the action-receiving portion 61 can be formed together with the case 21, thereby reducing the production cost and, further, making it easier for the action-receiving portions 61 to be pressed by the slide support members 40 of the urging devices 42 provided on the photosensitive member cartridge 3.

The right and left urging devices 42 are disposed on inner surfaces of the right and left sides of the photosensitive member cartridge 3, and are connected thereto in such a manner that the urging devices 42 are capable of changing the posture between a direction of the urging force thereof and a non-urging direction. Therefore, if the developer cartridge 4 is simply placed over or adjacent to the photosensitive member cartridge 3, the developing roller 22 is not pressed against the photosensitive drum 13. Hence, the photosensitive member cartridge 3 and the developer cartridge 4 can be combined as a process unit 2 for packing and shipping, while obviating the danger of permanent deformation of the outer peripheral surface of the process unit 2, or the danger of contamination of the photosensitive drum 13 with material components from the developing roller 22.

Still further, since each urging device 42 is substantially made up of the pivot fulcrum member 39, the slide support member 40 slidable relative to the pivot fulcrum member 39, and the urging spring device 41 disposed between the two members, the urging devices 42 gain an increased degree of freedom in changing the posture between the urging direction and the non-urging direction, compared with a conventional device that employs an urging spring to directly press an action-receiving portion and discontinue the pressing. Another advantage that the operations of pressing the action-receiving portions 61, and discontinuing the pressing, can be reliably performed by the slide support members 40 can also be achieved.

Further, since each urging device 42 is rotatably connected at its pivot fulcrum member 39 to the inner surface of the right or left side of the case 30 of the photosensitive member cartridge 3, most of the component parts of the urging devices 42 are unexposed outside the case 30, regardless of whether the photosensitive member cartridge 3 stands alone or is combined with the developer cartridge 4 into the process unit 2. Therefore, the danger of accidentally hitting and breaking any component part of the urging devices 42 is considerably reduced, and the ease of handling improves.

The slide support member 40 of each urging device 42 is provided integrally with the pin-like motion acting portion 43 protruding laterally to guide the slide support member 40 into the urging direction and the non-urging direction. The motion acting portions 43 of the urging devices 42 protrude outward from guide holes 44 in the right and left sides of the case 30 of the photosensitive member cartridge 3. Thus, most of the component parts of the urging devices 42 are unexposed outside the case 30. Therefore, the danger of accidentally hitting and breaking any component part of the urging devices 42 is considerably reduced, and the ease of handling improves.

The process unit 2 is designed so as to be removably set into the body housing 1 of the image forming apparatus. The body housing 1 is provided with the guide devices 55 that guide the urging devices 42 and switch the urging devices 42 between the urging state and the non-urging state. Therefore, the posture of the urging devices 42 and the operation thereof will be changed or switched simply by setting the process unit 2 into the body housing 1 or removing the process unit 2 from the body housing 1. Thus, the ease of operation considerably improves.

Although in the foregoing embodiment, the process unit 2 is removably set into the body housing 1 after the developer cartridge 4 has been set with respect to the photosensitive member cartridge 3, it is also possible to adopt a structure in which a photosensitive member cartridge and a developer cartridge can be separately set into and removed from a body housing.

In such a structure, guide grooves, that slidably guide and support the bearings 23*a*, 23*b* disposed on both ends of the developing roller shaft 22*a* and that protrude from the right and left side outer surfaces of the developer cartridge, are formed on the right and left sides of the body housing. Weight receiving or bearing members that support the load of a toner containing chamber side portion of the developer cartridge, that is, a portion remote from the developing roller 22, may also be provided at appropriate positions in the body housing.

It is to be understood that the invention is not restricted to the particular forms shown in the foregoing embodiment. Various modifications and alternations can be made thereto without departing from the scope of the invention.

What is claimed is:

1. An image forming apparatus for use with developer, comprising:

a photosensitive member on which an electrostatic latent image is formed;

a developer cartridge having a case, developing roller that supplies the developer to the photosensitive member, and a developing roller shaft having opposite end portions, the opposite end portions of the developing roller shaft extending so as to protrude outwardly from the case; and a guide which guides the developer cartridge to a position wherein the developing roller faces the photosensitive member, and which guides and supports the opposite end portions of the developing roller shaft so that the developer cartridge is pivotable about the developing roller shaft at the position where the developing roller faces the photosensitive member.

2. The image forming apparatus according to claim 1, further comprising an urging device that presses the developing roller against the photosensitive member via the developer cartridge.

3. The image forming apparatus according to claim 2, further comprising an apparatus body and a photosensitive member cartridge that houses the photosensitive member and that is detachably attachable to the apparatus body, wherein the guide and the urging device are disposed on the photosensitive member cartridge, and wherein the developer cartridge is detachably attachable to the photosensitive member cartridge to form a process unit.

4. The image forming apparatus according to claim 2, wherein during execution of an image forming operation, a direction of a rotation moment about the developing roller shaft caused by a friction force that the developing roller receives from the photosensitive member becomes substantially the same as a direction of a rotation moment about the developing roller shaft caused by a load at a center of gravity of the developer cartridge, and wherein the image forming apparatus further comprises a receiving member that receives the rotation moment caused by the friction force and the rotation moment caused by the load at the center of gravity of the developer cartridge.

5. The image forming apparatus according to claim 2, wherein a direction of a rotation moment about the developing roller shaft caused by a friction force that the developing roller receives from the photosensitive member, a direction of a rotation moment about the developing roller shaft caused by load at a center of gravity of the developer cartridge, and a direction of a rotation moment about the developing roller shaft caused by a force transmitted to the developing roller shaft via an external power transmitting device become substantially the same, and wherein the image forming apparatus further comprises a receiving member that receives the rotation moment caused by the friction force, the rotation moment caused by the load at the center of gravity of the developer cartridge, and the rotation moment caused by the force transmitted via the external power transmitting device.

6. The image forming apparatus according to claim 1, wherein the guide has a guide groove, and the end portions of the developing roller shaft are provided with shaft bearings that are rotatable and slidable relative to the guide groove.

7. The image forming apparatus according to claim 6, further including a spring disposed at an end portion of the developing roller shaft that urges one of the bearings outwardly in an axial direction of the developing roller shaft.

8. The image forming apparatus according to claim 7, wherein the one bearing is attached to the developing roller shaft and the spring so as to be movable in the axial direction of the developing roller shaft without detaching from the developing roller shaft.

9. The image forming apparatus according to claim 8, wherein the guide groove is substantially arcuate.

10. The image forming apparatus according to claim 3, wherein the urging device includes a spring member, the urging device being manually rotatable against a force exerted by the spring member.

11. The image forming apparatus according to claim 10, wherein the developer cartridge includes an action receiving portion that extends from an exterior of the developer cartridge, such that the action receiving portion contacts the urging device to rotate the urging device a predetermined distance against the force exerted by the spring member as the developer cartridge is attached to the photosensitive member.

12. The image forming apparatus according to claim 11, wherein the action receiving portion includes a locking surface that communicates with the urging device to impede the detachment of the developer cartridge from the photosensitive member after the urging device rotates the predetermined distance against the force of the spring.

13. The image forming apparatus according to claim 3, wherein the photosensitive member cartridge includes planar contacting portions that extend from a bottom exterior surface so as to enable the process unit to stably rest on a planar surface.

14. The image forming apparatus according to claim 13, wherein the bottom exterior surface of the photosensitive member cartridge extends along and below a bottom surface of the developer cartridge when the developer cartridge is attached to the photosensitive member cartridge.

15. The image forming apparatus according to claim 13, wherein the developer cartridge includes a grip which enables a user with one hand to stably support the process unit by only grasping the developer cartridge.

16. The image forming apparatus according to claim 13, wherein the developer cartridge includes a grip which enables a user with one hand to stably support the process unit by grasping the developer cartridge and the bottom exterior surface of the photosensitive member cartridge.

17. The image forming apparatus according to claim 3, wherein the photosensitive member cartridge includes a paper feed roller that is at least partially exposed at a bottom exterior surface of the photosensitive member cartridge.

18. The image forming apparatus according to claim 1, further including gears that communicate a force to the photosensitive member and the developing roller, the gears being disposed only at one side of the image forming apparatus.

19. A photosensitive member cartridge for use with an image forming apparatus and a developer cartridge having a developing roller that supplies developer to the photosensitive member cartridge, the developer cartridge being attachable to and detachable from the photosensitive member cartridge, and a developing roller shaft that has opposite end portions, the photosensitive member cartridge comprising:

a photosensitive member on which an electrostatic latent image is formed and that receives the developer from the developing roller;

a guide groove that supports the opposite end portions of the developing roller shaft of the developing roller and guides the developing roller in such directions that the developing roller contacts and separates from the photosensitive member, the photosensitive member cartridge being attachable to and detachable from the image forming apparatus when the developer cartridge is attached to the photosensitive member cartridge.

20. The photosensitive member cartridge according to claim 19, further comprising an urging device that presses the developing roller against the photosensitive member via the developer cartridge.

21. The photosensitive member cartridge according to claim 20, wherein the guide groove and the urging device are provided on each of opposite sides of the photosensitive member cartridge.

22. The photosensitive member cartridge according to claim 19, wherein a direction of a rotation moment about the developing roller shaft caused by a friction force that the developing roller receives from the photosensitive member becomes substantially the same as a direction of a rotation moment about the developing roller shaft caused by a load at a center of gravity of the developer cartridge, and wherein the image forming apparatus further comprises a receiving member that receives the rotation moment caused by the friction force and the rotation moment caused by the load at the center of gravity of the developer cartridge.

23. A developer cartridge for use with developer, an image forming apparatus, a photosensitive member on which an electrostatic latent image is formed, and a photosensitive member cartridge that houses the photosensitive member, comprising:

a developing roller that supplies the developer to the photosensitive member; and a developing roller shaft having opposite end portions that protrude from opposite sides of an exterior of the developer cartridge, wherein the developer cartridge is removably attachable to, detachable from, and rotatable relative to, one of the photosensitive member cartridge and the image forming apparatus, so that the developer cartridge may be replaced independently of the photosensitive member cartridge.

24. The developer cartridge according to claim 23, wherein the photosensitive member cartridge includes an urging device that presses the developing roller against the photosensitive member, the developer cartridge further comprising pressing force-receiving portions that communicate with the urging device that presses the developing roller against the photosensitive member, the pressing force-receiving portions protruding from opposite sides of the exterior of the developer cartridge.

25. The developer cartridge according to claim 23, further comprising bearings fitted to the opposite end portions of the developing roller shaft in such a manner that the bearings are prevented from detaching from the developing roller shaft.

26. The developer cartridge according to claim 25, wherein at least one of the bearings is urged outwardly in a direction of an axis of the developing roller shaft.

27. The developer cartridge according to claim 23, wherein the end portions of the developing roller shaft are provided with shaft bearings that are rotatable and slidable relative to a guide groove defined by the photosensitive member cartridge.

28. The developer cartridge according to claim 27, further including a spring disposed at an end portion of the developing roller shaft that urges one of the bearings outwardly in an axial direction of the developing roller shaft.

29. The developer cartridge according to claim 28, wherein the one bearing is attached to the developing roller shaft and the spring so as to be movable in the axial direction of the developing roller shaft without detaching from the developing roller shaft.

30. The developer cartridge according to claim 23, further including a grip which enables a user with one hand to stably support the developer cartridge when attached to the photosensitive member cartridge by only grasping the developer cartridge.

31. The developer cartridge according to claim 23, further including gears that communicate a force to at least the developing roller, the gears being disposed only at one side of the developer cartridge.

32. A method of forming an image with developer, comprising the steps of:

forming an electrostatic latent image on a photosensitive member;

supplying the developer to the photosensitive member with a developing roller of a developer cartridge, the developing roller having a developing roller shaft that includes opposite end portions that protrude outwardly from a case of the developer cartridge; and guiding the developer cartridge to a position wherein the developing roller faces the photosensitive member by guiding and supporting the opposite end portions of the developing roller shaft so that the developer cartridge is oscillatable about the developing roller shaft at the position wherein the developing roller faces the photosensitive member.

33. An image forming apparatus for use with developer, comprising:

means for forming an electrostatic latent image, the means for forming including a photosensitive member;

means for supplying the developer to a developing roller of a developer cartridge, the developing roller having a developing roller shaft that includes opposite end portions that protrude outwardly from a case of the developer cartridge; and means for guiding the developer cartridge to a position wherein the developing roller faces the photosensitive member by guiding and supporting the opposite end portions of the developing roller shaft so that the developer cartridge is oscillatable about the developing roller shaft at the position wherein the developing roller faces the photosensitive member.

34. A cartridge assembly for use with an image forming apparatus and developer, comprising:

a photosensitive member on which an electrostatic latent image is formed;

a developer cartridge having a case, developing roller that supplies the developer to the photosensitive member, and a developing roller shaft having opposite end portions, the opposite end portions of the developing roller shaft extending so as to protrude outwardly from the case; and a guide which guides the developer cartridge to a position wherein the developing roller faces the photosensitive member, and which guides and supports the opposite end portions of the developing roller shaft so that the developer cartridge is oscillatable about the developing roller shaft at the position wherein the developing roller faces the photosensitive member.

35. The image forming apparatus according to claim 3, wherein the urging device is not manually accessible to an operator when the photosensitive member cartridge is attached to the developer cartridge and then attached to the apparatus body.

36. The image forming apparatus according to claim 9, further comprising a photosensitive member cartridge that houses the photosensitive member, the guide groove being defined by the photosensitive member cartridge, the developer cartridge being detachably attachable to the photosensitive member cartridge, wherein when the developer cartridge is being attached to the photosensitive member cartridge, the shaft bearings contact and move along a first section of the guide groove in a direction that includes a vertical component and then contact and move along a second section of the guide groove in a direction that is substantially horizontal, the movement along the first section being performed faster than the movement along the second section.

* * * * *